US009581408B2

(12) United States Patent
Prater

(10) Patent No.: US 9,581,408 B2
(45) Date of Patent: Feb. 28, 2017

(54) CABLE GUARD FOR COMPOUND BOW

(71) Applicant: Prater Custom Archery, LLC, Davison, MI (US)

(72) Inventor: Don C. Prater, Davison, MI (US)

(73) Assignee: Prater Custom Archery, LLC, Davison, MI (US)

( * ) Notice: Subject to any disclaimer, the term of this patent is extended or adjusted under 35 U.S.C. 154(b) by 0 days.

(21) Appl. No.: 14/862,783

(22) Filed: Sep. 23, 2015

(65) Prior Publication Data

US 2016/0084607 A1 Mar. 24, 2016

Related U.S. Application Data

(60) Provisional application No. 62/053,890, filed on Sep. 23, 2014.

(51) Int. Cl.
*F41B 5/14* (2006.01)
*F41B 5/10* (2006.01)

(52) U.S. Cl.
CPC ..... *F41B 5/14* (2013.01); *F41B 5/10* (2013.01); *F41B 5/148* (2013.01)

(58) Field of Classification Search
CPC ..... F41B 5/10; F41B 5/14
USPC ..... 124/25.6, 86, 88
See application file for complete search history.

(56) References Cited

U.S. PATENT DOCUMENTS 4,203,412 A 5/1980 Rickard
4,917,070 A * 4/1990 Townsend ..... F41B 5/10 124/23.1
4,919,108 A * 4/1990 Larson ..... F41B 5/10 124/25.6
5,623,915 A 4/1997 Kudlacek
5,651,355 A * 7/1997 Gallops, Jr. ..... F41B 5/10 124/25.6
5,720,269 A * 2/1998 Saunders ..... F41B 5/1407 124/25.6
5,722,385 A * 3/1998 Bunk ..... F41B 5/10 124/25.6
5,983,880 A * 11/1999 Saunders ..... F41B 5/10 124/25.6
6,152,124 A * 11/2000 Gallops, Jr. ..... F41B 5/10 124/25.6
6,371,098 B1 4/2002 Winther et al.
6,659,096 B1 12/2003 Nealy, Sr. et al.
6,715,479 B1 * 4/2004 Bunk ..... F41B 5/10 124/25.6

(Continued)

OTHER PUBLICATIONS http://www.archerytalk.com/vb/showthread.php?t=2216756; Mar. 21, 2014; pp. 1-9.

(Continued)

*Primary Examiner* — Alexander Niconovich
(74) *Attorney, Agent, or Firm* — Bejin Bieneman PLC

(57) ABSTRACT

A cable guard for a compound bow includes a rod extending along an axis, and a base releasably fixed to the rod and adjustable relative to the rod along the axis. The cable guard includes a lock releasably fixing the base to the rod along the axis. A pair of bearings each supported by the base. The base, and the pair of bearings supported by the base, are adjustable along the axis for adjustment relative to a riser of the compound bow. The lock fixes the base at a desired position along the axis relative to the riser.

14 Claims, 19 Drawing Sheets

(56) References Cited

U.S. PATENT DOCUMENTS 6,722,354 B1 * 4/2004 Land ..... F41B 5/10 124/25.6
6,729,320 B1 5/2004 Terry
6,758,204 B1 * 7/2004 Goff ..... F41B 5/10 124/25.6
6,904,900 B2 * 6/2005 Gallops, Jr. ..... F41B 5/10 124/25.6
8,056,548 B1 * 11/2011 Larson ..... F41B 5/1426 124/23.1
8,176,906 B2 * 5/2012 Simo ..... F41B 5/10 124/25.6
8,225,779 B2 7/2012 Evans
8,371,283 B2 * 2/2013 Grace ..... F41B 5/10 124/25.6
8,402,960 B2 * 3/2013 McPherson ..... F41B 5/10 124/25.6
8,485,169 B2 * 7/2013 Dahl, II ..... F41B 5/10 124/25.6
8,616,189 B2 * 12/2013 McPherson ..... F41B 5/10 124/23.1
8,622,052 B1 * 1/2014 McPherson ..... F41B 5/14 124/86
8,651,097 B2 * 2/2014 Grace, Jr. ..... F41B 5/10 124/25.6
8,671,929 B2 * 3/2014 McPherson ..... F41B 5/10 124/23.1
8,813,737 B2 * 8/2014 Langley ..... F41B 5/14 124/25.6
8,820,304 B2 * 9/2014 Batdorf ..... F41B 5/10 124/25.6
8,950,388 B2 * 2/2015 McPherson ..... F41B 5/1403 124/25.6
9,046,317 B2 * 6/2015 McPherson ..... F41B 5/1426
9,285,179 B2 3/2016 Prater
2010/0071677 A1 3/2010 Cooper
2010/0132685 A1 * 6/2010 De Sousa ..... F41B 5/14 124/88
2010/0263650 A1 * 10/2010 Dahl, II ..... F41B 5/10 124/25.6
2010/0282226 A1 * 11/2010 Marzullo ..... F41B 5/14 124/25.6
2011/0073090 A1 * 3/2011 McPherson ..... F41B 5/10 124/25.6
2011/0192385 A1 * 8/2011 Clark ..... F41B 5/105 124/25.6
2011/0247602 A1 * 10/2011 McPherson ..... F41B 5/10 124/25.6
2012/0042861 A1 * 2/2012 Anselmo ..... F41B 5/10 124/25.6
2012/0325195 A1 * 12/2012 Dahl, II ..... F41B 5/10 124/88
2013/0055995 A1 * 3/2013 Batdorf ..... F41B 5/14 124/25.6
2013/0055997 A1 * 3/2013 Badgerow ..... F41B 5/1403 124/88
2013/0061838 A1 * 3/2013 Gordon ..... F41B 5/14 124/25.6
2013/0247888 A1 * 9/2013 McPherson ..... F41B 5/10 124/25.6

OTHER PUBLICATIONS http://www.biggamehunt.net/reviews/bear-archery-anarchy-bow-review; Dec. 13, 2011; pp. 1-6.

* cited by examiner

FIG. 3A
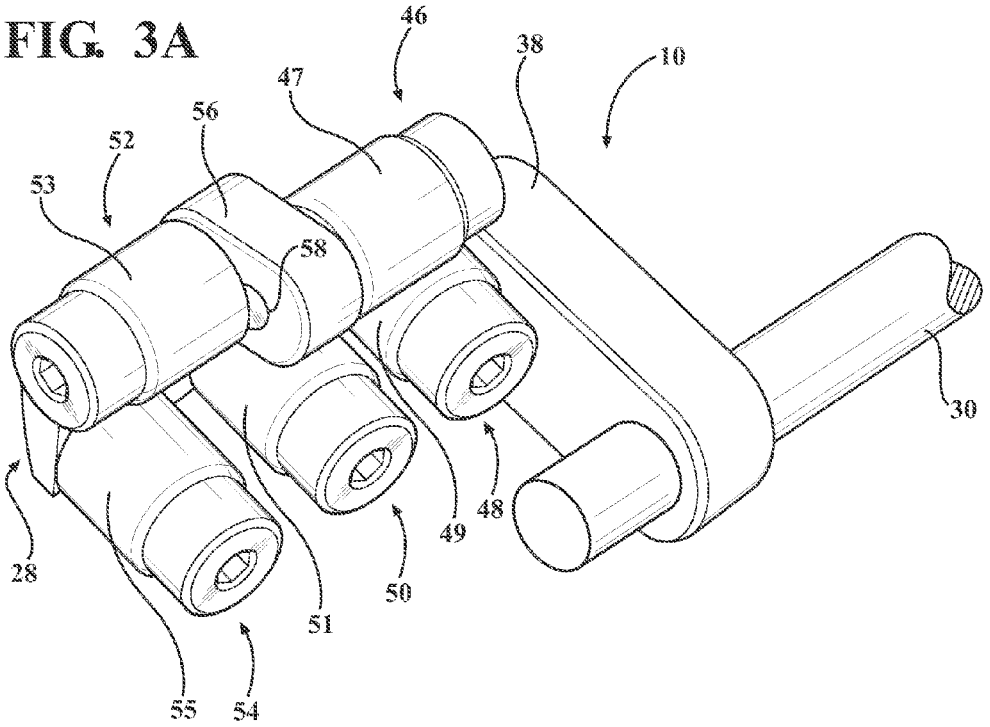
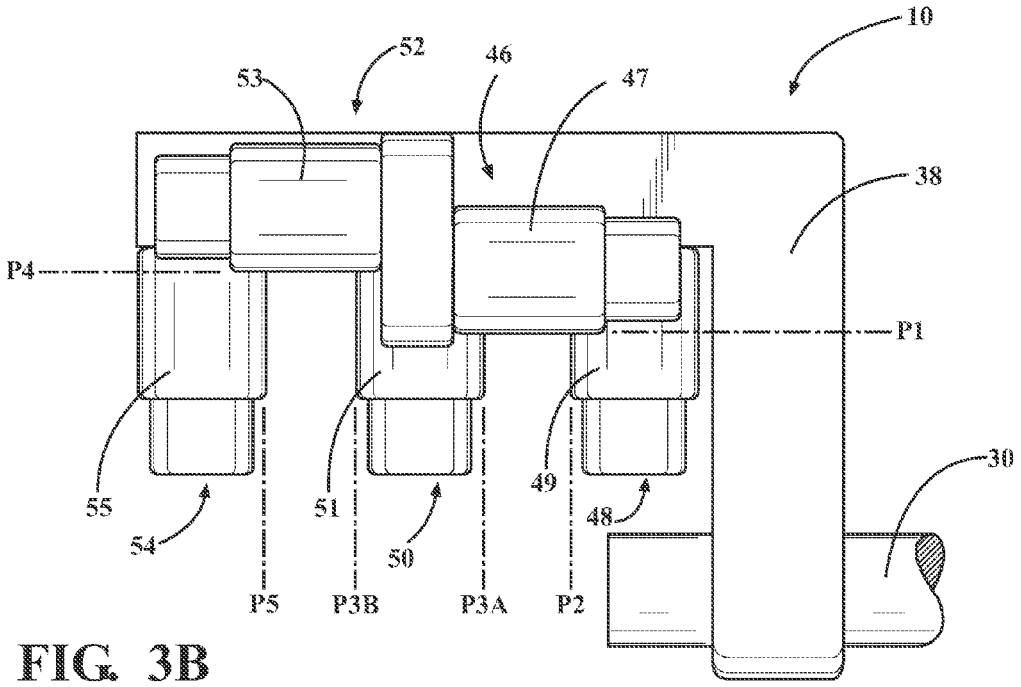
FIG. 3B

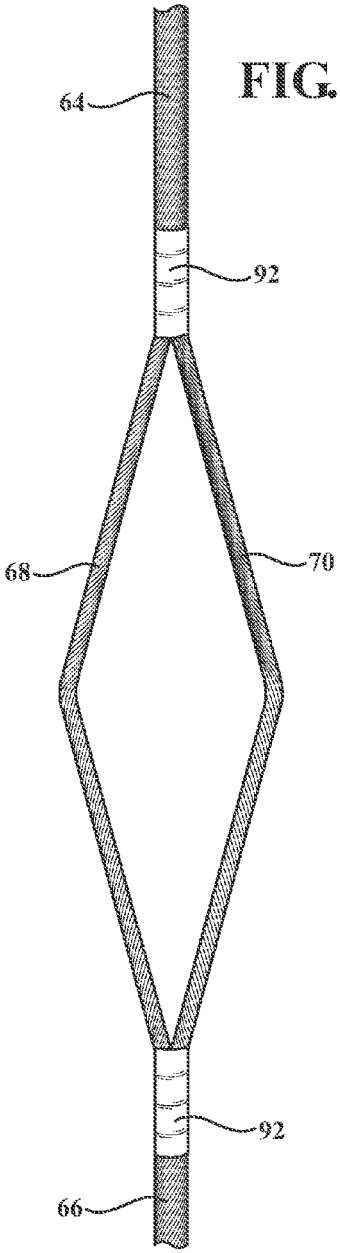
FIG. 13
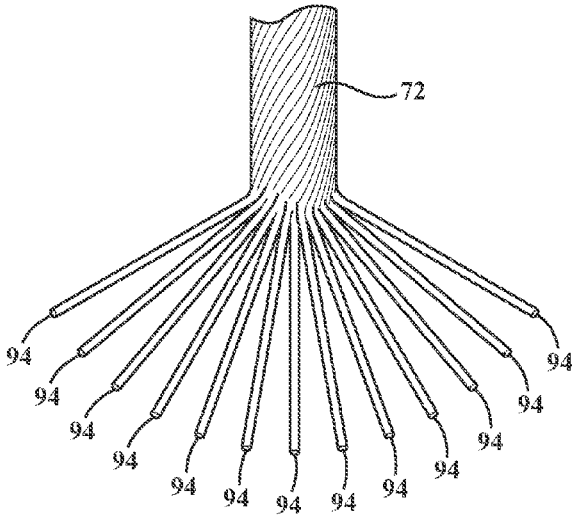
FIG. 14
FIG. 15A
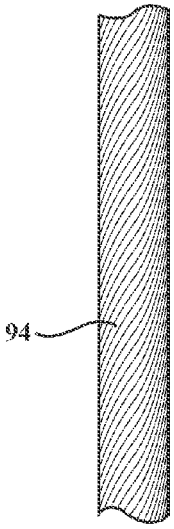
FIG. 15B
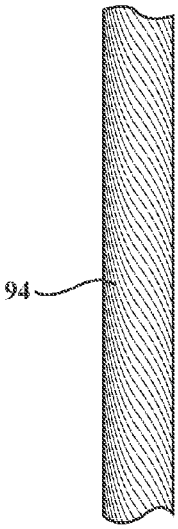

CABLE GUARD FOR COMPOUND BOW

CROSS-REFERENCE TO RELATED APPLICATIONS

The subject patent application claims priority to and all the benefits of U.S. Provisional Patent Application No. 62/053,890 filed on Sep. 23, 2014, which is herein incorporated by reference in its entirety.

BACKGROUND

1. Field

The present disclosure is directed toward a cable guard for a compound bow for directing at least one cable of the compound bow away from the path of an arrow on the compound bow.

2. Description of the Related Art

A compound archery bow includes a riser and a pair of limbs extending from opposing ends of the riser. Each limb supports a pulley. A string extends between and is connected to the pulleys. Free of external forces, the string and limbs are typically in a brace position and the string can be loaded with an arrow and drawn to move the string and limbs to a drawn position before propelling the arrow.

At least one cable extends between the pulleys for assisting in movement of the string and limbs to the drawn position. For example, one cable is connected to and extends from one pulley to the opposite limb and another cable is connected to and extends from the other pulley to the other limb.

By drawing the string from the brace position to the drawn position, the string rotates the pulleys thereby drawing in the cables and pulling the limbs toward each other. Specifically, an arrow is loaded on the string and the string is drawn from the brace position to the drawn position and subsequently released to propel the arrow. When the limbs are flexed and drawn toward each other as the string is drawn, the limbs are loaded, and subsequent release of the string allows the limbs to unload to return the string to the brace position and propel the arrow.

The bow typically includes a cable guard for deflecting the cables away from the path of the arrow and away from a plane in which the string travels to prevent interference between the cables and the arrow and string. When the string is moved between the brace position and the drawn position, the rotating pulleys move the cables vertically relative to the cable guard and the rotating pulleys and flexing limbs urge the cables fore and aft relative to the cable guard. Over time, relative movement between the cables and the cable guard wears both the cables and the cable guard. This wear can generate unwanted noise and undesirably complicate the operation of the bow.

SUMMARY AND ADVANTAGES

A cable guard comprises a rod extending along an axis. A base is releasably fixed to the rod and is adjustable relative to the rod along the axis. A lock releasably fixes the base to the rod along the axis. A pair of bearings are each supported by the base.

The cable guard is mountable to a riser of a compound bow. Since the base is adjustable along the axis of the rod, the base, and the pair of bearings supported by the base, may be adjusted along the axis of the rod for adjustment relative to other components the compound bow, including the riser. When the base is adjusted to a desired position along the axis of the rod relative to the other components of the compound bow, the lock fixes the base at a desired position along the axis relative to the riser. The compound bow may then be operated with the base and the pair of bearings locked in the desired position along the axis of the rod.

BRIEF DESCRIPTION OF THE DRAWINGS

Other advantages of the present disclosure will be readily appreciated, as the same becomes better understood by reference to the following detailed description when considered in connection with the accompanying drawings wherein:

FIG. 3A is a perspective view of the first embodiment of the cable guard;

FIG. 3B is a top view of the cable guard of FIG. 3A

and

Figure 9:
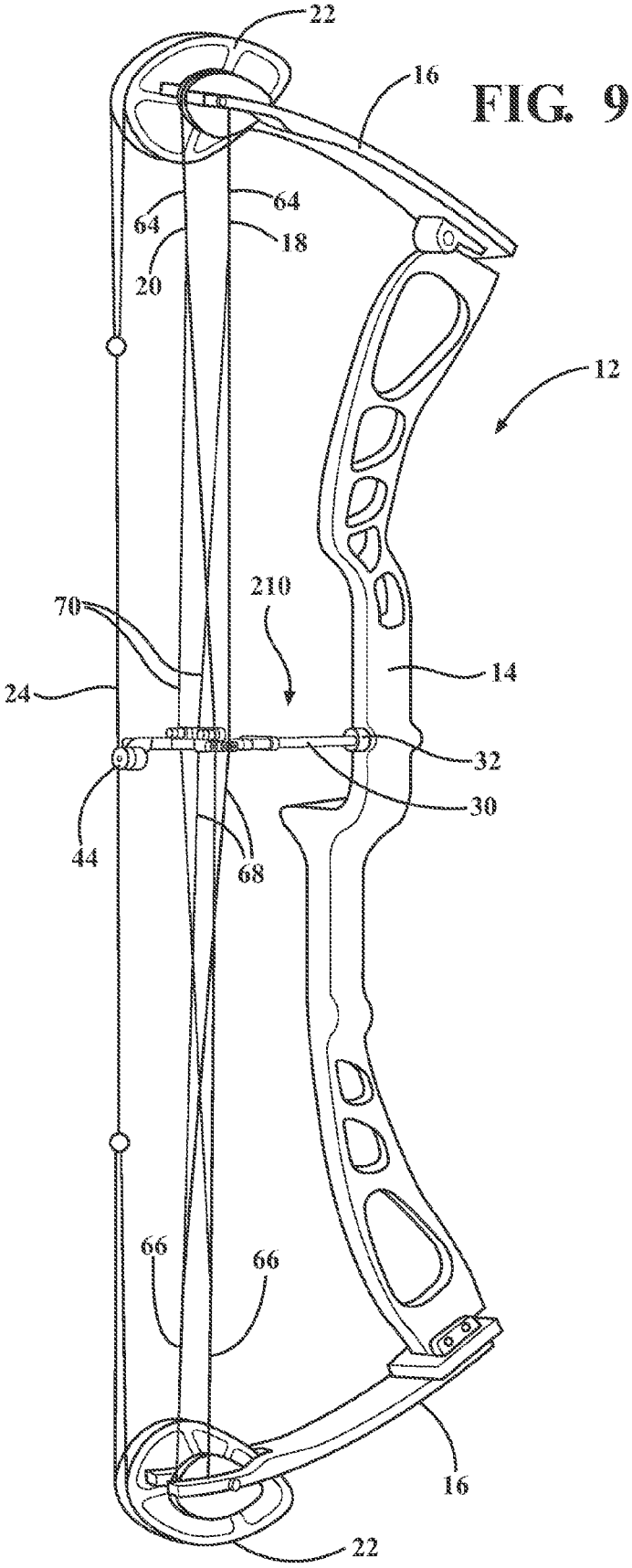
FIG. 9 is a perspective view of a compound bow in a brace position and including a third embodiment of the cable guard.
Figure 16:
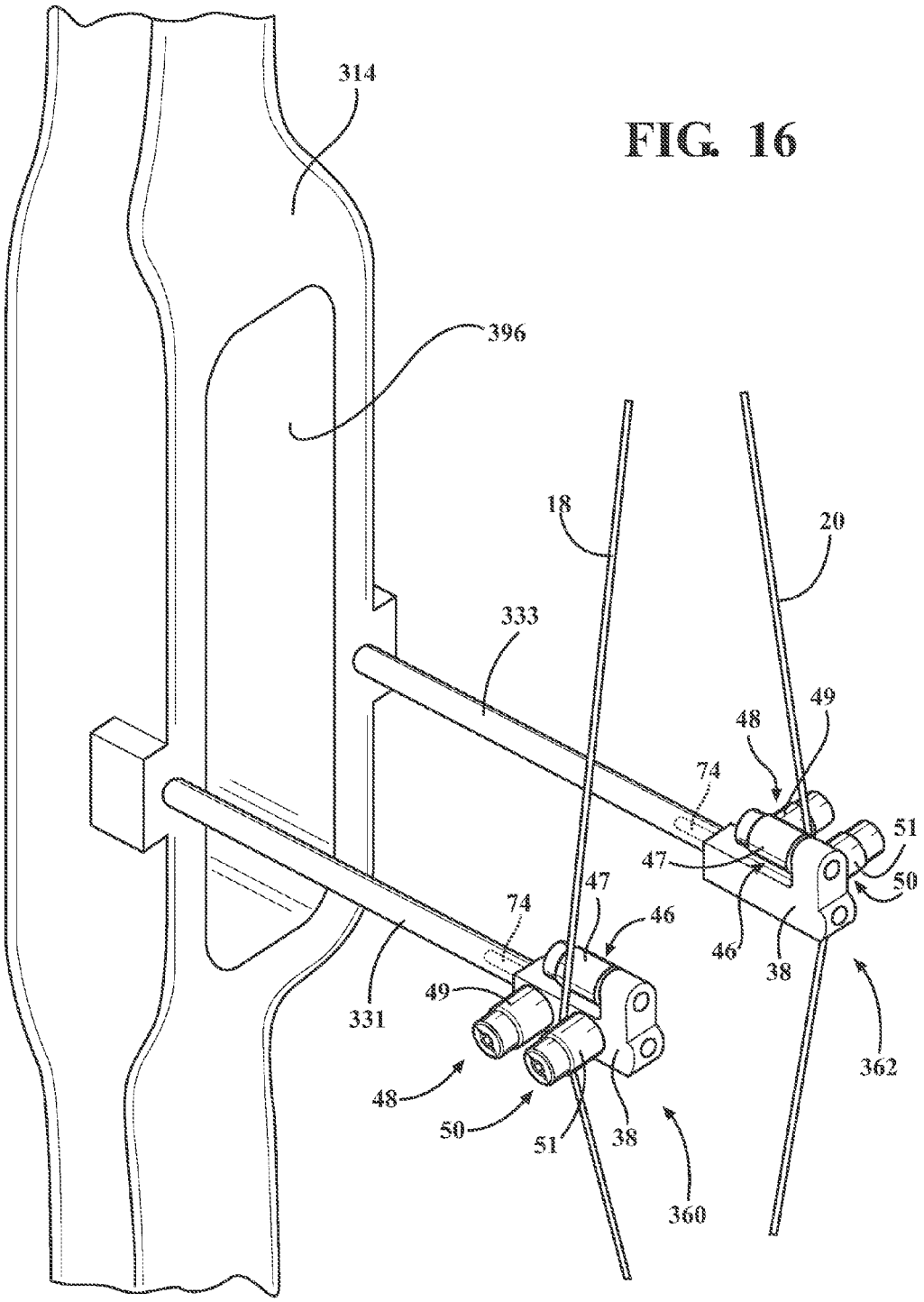
Figure 17:
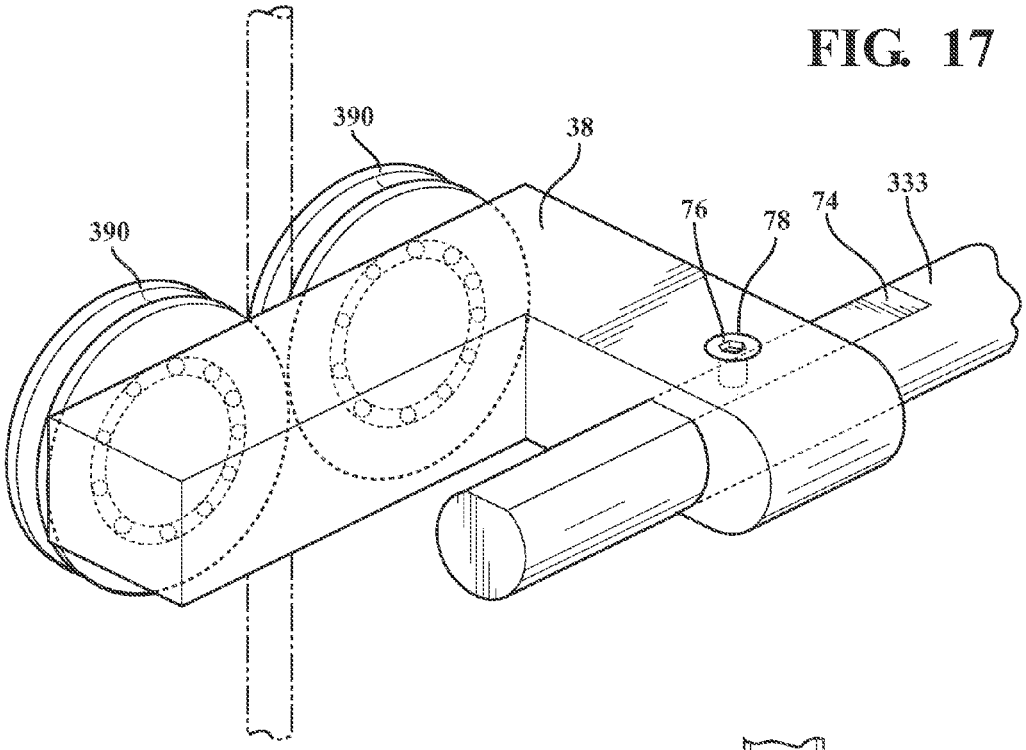
Figure 18:
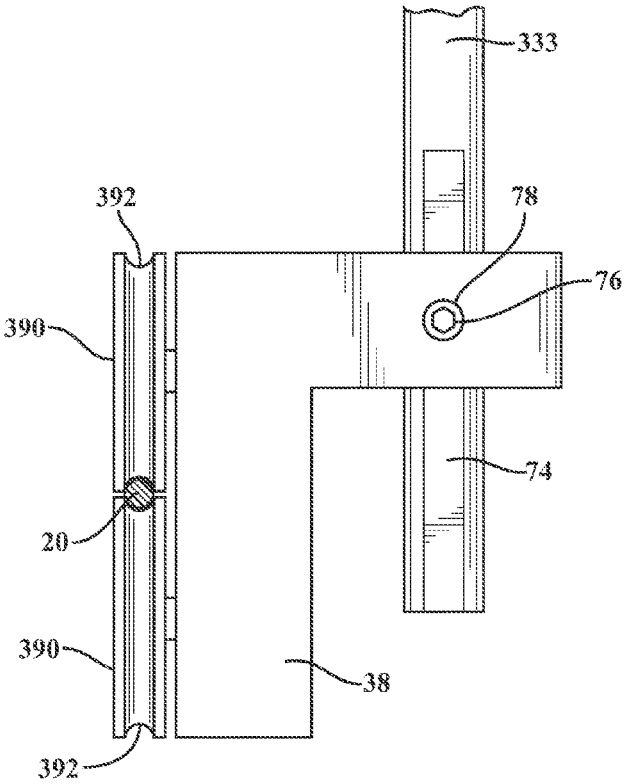

FIG. 13 is a perspective view of a cable of the compound bow of FIG. 9;

FIG. 14 is a perspective view of a strand of the cable including a plurality of fibers exploded at one end for illustrative purposes;

FIG. 15A is a perspective view of a fiber of the strand with a left twist;

FIG. 15B is a perspective view of a fiber of the strand with a right twist;

FIG. 16 is a perspective view of a portion of a shoot-through riser including a fourth embodiment of the cable guard;

FIG. 17 is a perspective view of the fourth embodiment of the cable guard including alternative bearings; and FIG. 18 is a bottom view of the cable guard of FIG. 17.

DETAILED DESCRIPTION

With reference to the Figures, wherein like numerals indicate like parts throughout the several views, a cable guard 10, 110, 210, 310 for a compound bow 12 is shown. The compound bow 12 can be of any suitable type.

Figure 1:
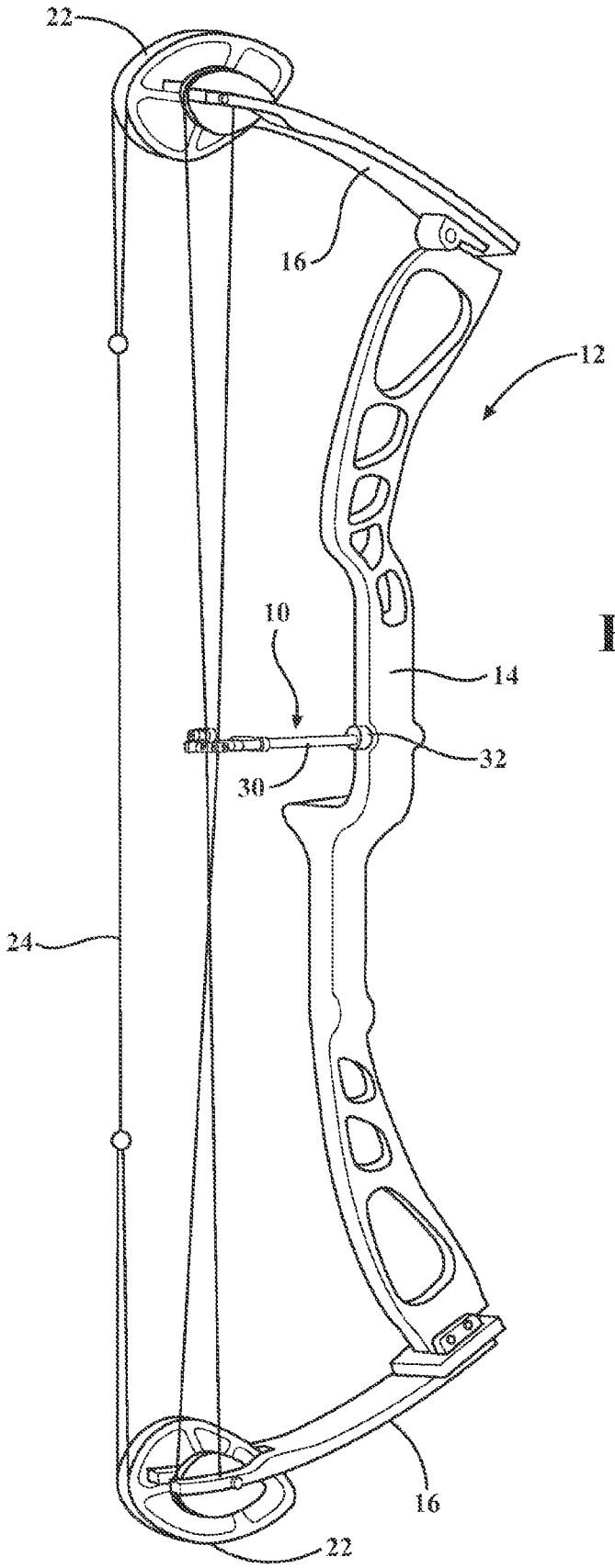
FIG. 1 is a perspective view of a compound bow in a brace position and including a first embodiment of a cable guard.
Figure 2:
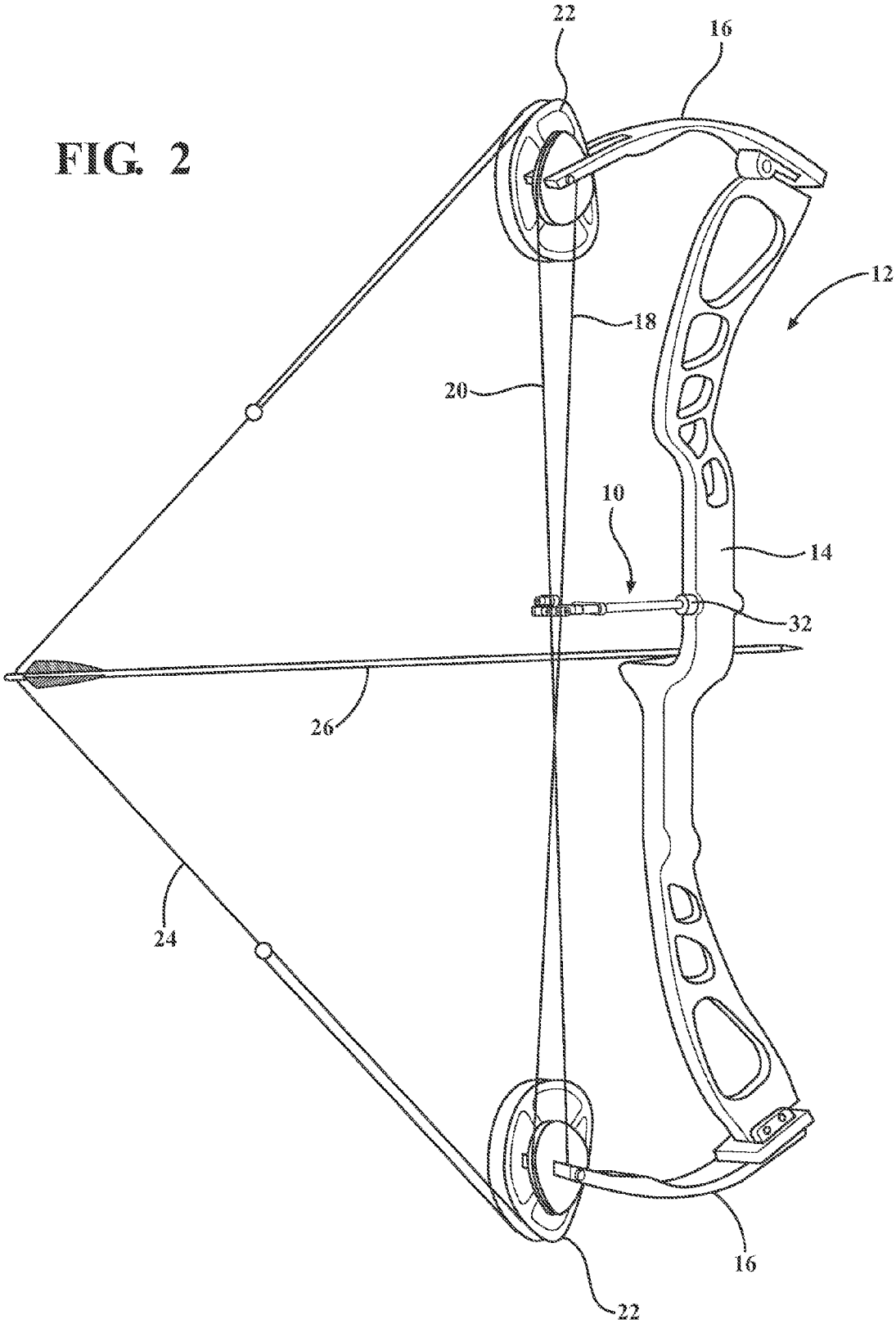
FIG. 2 is a perspective view of the compound bow of FIG. 1 in the drawn position.

With reference to FIGS. 1 and 2, the compound bow 12 includes a riser 14 and a pair of limbs 16 extending from opposing ends of the riser 14. At least one cable extends between the limbs 16. For example, as shown in FIGS. 1 and 2, typically two cables, identified as a first cable 18 and a second cable 20 below, extend between the limbs 16. Pulleys 22 are disposed on each limb 16 and the first cable 18 extends from one pulley 22 to the opposing limb 16 and the second cable 20 extends from the other pulley 22 to the other limb 16.

A string 24 extends between the limbs 16. Specifically, the string 24 is typically engaged with and extends between the pulleys 22. By drawing the string 24 from the brace position, as shown in FIG. 1, to the drawn position, as shown in FIG. 2, the string 24 rotates the pulleys 22 thereby drawing in the cables 18, 20 and resiliently flexing the limbs 16 toward each other. During this movement, the cables 18, 20 move vertically relative to the cable guard 10, 110, 210, 310. At least one of the pulleys 22 is typically cammed. The pulleys 22, and associated cables 18, 20, can be of any suitable type. For example, the pulleys 22 can be a single cam, hybrid cam, dual cam, binary cam, cam and a half, etc. The cammed pulley 22 on two limbs 16 may be identical to each other.

The cable guard 10, 110, 210, 310 deflects the cables 18, 20 away from the path of an arrow 26 loaded on the compound bow 12 and away from a plane in which the string 24 travels to prevent interference between the cables 18, 20 and the arrow 26 and string 24. A first embodiment of the cable guard 10 is shown in FIGS. 1-5, a second embodiment of the cable guard 110 is shown in FIGS. 6-8, a third embodiment of the cable guard 210 is shown in FIGS. 9-12; and a fourth embodiment of the cable guard 310 is shown in FIG. 13. Common features are identified with common numerals throughout the figures.

The cable guard 10, 110, 210, 310 includes a frame 28 for attachment to the compound bow 12. Specifically, the frame 28 is typically attached to and extends from the riser 14. The frame 28 can be formed of any suitable material such as, for example, aluminum, titanium, etc. The frame 28 can be formed, for example, by metal injection molding (MIM).

The frame 28 includes a rod 30 that is configured to be removably coupled with the riser 14. For example, the riser 14 defines a bore (not numbered) to which the rod 30 can be coupled. As one example, the bore in the riser 14 directly receives the rod 30 with a set screw retaining the rod 30 in the bore.

Figure 11A:
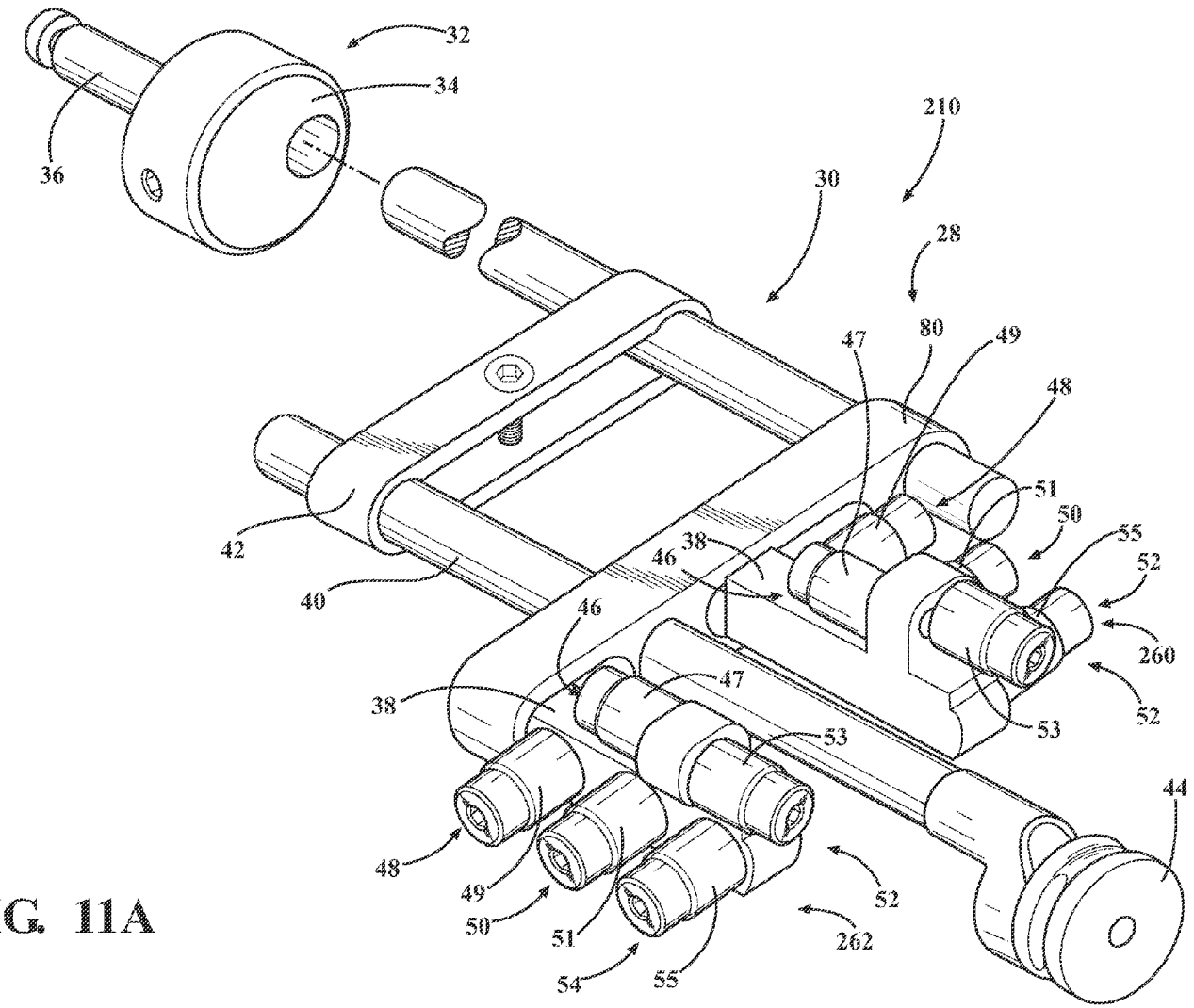
FIG. 11A is a partially exploded perspective view of the third embodiment of the cable guard.

Alternatively, an adapter 32 is coupled to the rod 30 and engages the bore of the riser 14, as shown in FIG. 11A. The adapter 32 includes an intermediate member 34 and a second rod 36 extending from the intermediate member 34 in an opposite direction than the rod 30. At least one of the rod 30 and the second rod 36 is selectively rotatable relative to the intermediate member 34. For example, as shown in FIG. 11, the rod 30 extends into a hole (not numbered) of the intermediate member 34 and is selectively fixed to the intermediate member 34 with a set screw. It should be appreciated that one or both of the rod 30 and the second rod 36 can be selectively rotatable and selectively fixed to the intermediate member 34 in any suitable fashion. While the adapter 32 is shown on the third embodiment of the cable guard 210, it should be appreciated that the adapter 32 may be used with any one of the embodiments of the cable guard 10, 110, 210, 310.

The rod 30 and the second rod 36 extend along axes that are offset from each other such that rotation of the rod 30 and/or the second rod 36 relative to the intermediate member 34 adjusts the position of the frame 28 relative to the riser 14. For example, in the embodiment shown in FIG. 11A, the second rod 36 is inserted into the riser 14 with the set screw loosened so that the rod 30 is rotatable relative to the intermediate member 34. The rod 30 and second rod 36 are rotated relative to each other to position the frame 28 in a desired position relative to the riser 14. When the desired position is attained, the rod 30 is fixed to the intermediate member 34 and the second rod 36 is fixed to the riser 14 to fix the frame 28 relative to the riser 14.

The frame 28 of the cable guard 10, 110, 210, 310 is stationary relative to the riser 14 as the string 24 moves between the brace position and the drawn position. Alternatively, the rod 30 can, for example, include a feature (not shown) that allows the rod 30 to flex to reduce cam lean.

The frame 28 includes a base 38 connected to the rod 30. The base 38 and the rod 30 can be formed separately and affixed to one another. Alternatively, the base 38 and the rod 30 can be integral, i.e., formed together from a single piece of material With reference to FIGS. 6-12, the frame 28 can include a reinforcing rod 40 extending from the base 38 and a brace 42 extending between the rod 30 and the reinforcing rod 40. The second rod 36 and the brace 42 provide additional torsional stability. The reinforcing rod 40 and the brace 42 are shown, for example, with the second and third embodiment of the cable guard 110, 210.

With reference to FIGS. 9-12, the frame 28 can support a string suppressor 44. The string suppressor 44 extends from the frame 28 toward the string 24 for contacting the string 24. Specifically, the string 24 contacts the string suppressor 44 as the string 24 moves from the drawn position to the brace position. The string suppressor 44 quiets the operation of the bow 12 and reduces vibration when the string 24 moves from the drawn position to the brace position. The string suppressor 44 is shown, for example, in the third embodiment of the cable guard 210; however, it should be appreciated that the first, second, and/or fourth embodiment of the cable guard 10, 110, 310 can also include the string suppressor 44.

With reference to FIGS. 1-5, the cable guard 10 of the first embodiment includes five bearings, namely a first bearing 46, a second bearing 48, a third bearing 50, a fourth bearing 52, and a fifth bearing 54 each supported by the frame 28. The first bearing 46, second bearing 48, and third bearing 50 are arranged in a U-shape to receive the first cable 18 in the U shape and the third bearing 50, fourth bearing 52, and fifth bearing 54 are arranged in a U-shape to receive the second cable 20 in the U-shape.

The bearings 46, 48, 50, 52, 54 are typically rotatable about their respective axis A1, A2, A3, A4, A5. As set forth above, the cables 18, 20 move vertically relative to the cable guard 10, 110, 210 and, in the configuration where the bearings rotate about their respective axis, the bearings rotate as the cables 18, 20 move. This rotation of the bearings reduces friction and associated wear on the cables 18, 20. The bearings 46, 48, 50, 52, 54, for example, can be needle bearings. Alternatively, for example, each bearing 46, 48, 50, 52, 54 can be a bushing on a shoulder bolt. The bushing can be, for example, ceramic, a plastic such as Delrin, Nylon, Teflon, etc., or any other suitable material. It should be appreciated that the bearings 46, 48, 50, 52, 54 can be of any suitable type.

As shown in FIGS. 1 and 2, the first cable 18 contacts the first bearing 46 and the second cable 20 contacts the fourth bearing 52. The first bearing 46 extends along an axis A1.

The fourth bearing 52 extends along an axis A4 that is typically parallel with the axis A1 of the first bearing 46. The axis A1 of the first bearing 46 and the axis A4 of the fourth bearing 52 are typically offset from each other to provide clearance between the first cable 18 and the second cable 20. The axes A1, A4 of the first bearing 46 and fourth bearing 52 can alternatively be non-parallel or can be overlapping, i.e., the first bearing 46 and the fourth bearing 52 can share a common axis.

The second bearing 48 and third bearing 50 each extend along a respective axis A2, A3 transverse to the axis A1 of the first bearing 46. The fifth bearing 54 is adjacent the third bearing 50 and the third bearing 50 and the fifth bearing 54 extend along an axis A5 transverse to the axis A4 of the fourth bearing 52.

The axes A2, A3, A5 of the second bearing 48, the third bearing 50, and the fifth bearing 54 are typically parallel to each other, as shown in FIGS. 1-5, and are typically in a common plane. Alternatively, the axes of at least one of the second bearing 48, the third bearing 50, and the fifth bearing 54 can be non-parallel to the others and or in a different plane than the others.

In the configuration in which the axes A2, A3, A6 of the second bearing 48, the third bearing 50, and the fifth bearing 54 are parallel to each other, as shown in FIGS. 1-5, the axes A2, A3 of the second bearing 48 and the third bearing 50 are typically perpendicular to the axis A1 of the first bearing 46, and the axes A3, A5 of the third bearing 50 and the fifth bearing 54 are typically perpendicular to the axis A4 of the fourth bearing 52.

The second bearing 48 and the third bearing 50 each present a bearing surface 49, 51 with the bearing surface 49 of the second bearing 48 spaced from and facing the bearing surface 51 of the third bearing 50 for receiving one of the cables 18, 20 therebetween, e.g., the first cable 18 as shown in FIGS. 1 and 2. The first bearing 46 presents a bearing surface 47 and the bearing surfaces 49, 51 of the second bearing 48 and the third bearing 50 extend transverse to the bearing surface 47 of the first bearing 46. In other words, as shown in FIG. 3B, the bearing surface 47 of the first bearing 46 extends in a plane P1 intersected by the bearing surfaces 49, 51 of the second bearing 48 and the third bearing 50, and the bearing surfaces 49, 51 of the second bearing 48 and the third bearing 50 each extend in planes P2, P3A, respectively, intersected by the bearing surface 47 of the first bearing 46. The bearing surfaces 49, 51 of the second bearing 48 and third bearing 50 are typically spaced from the bearing surface 47 of the first bearing 46 along the plane P1, as shown in FIG. 3, but, alternatively, can contact the bearing surface 47 of the first bearing 46.

The fifth bearing 54 presents a bearing surface 55 spaced from and facing the bearing surface 51 of the third bearing 50 for receiving one of the cables 18, 20 therebetween, e.g., the second cable 20 as shown in FIGS. 1 and 2. The fourth bearing 52 presents a bearing surface 53 and the bearing surfaces 51, 55 of the third bearing 50 and the fifth bearing 54 extend transverse to the bearing surface 53 of the fourth bearing 52. In other words, as shown in FIG. 3B, the bearing surface 53 of the fourth bearing 52 extends in a plane P4 intersected by the bearing surfaces 51, 55 of the third bearing 50 and the fifth bearing 54, and the bearing surfaces 51 of the third bearing 50 and the fifth bearing 54 each extend in planes P3B, P5, respectively, intersected by the bearing surface 53 of the fourth bearing 52. The bearing surfaces 51, 55 of the third bearing 50 and fifth bearing 54 are typically spaced from the bearing surface 53 of the fourth bearing 52 along the plane P4, as shown in FIG. 3B, but alternatively can contact the bearing surface 53 of the fourth bearing 52.

Figure 5:
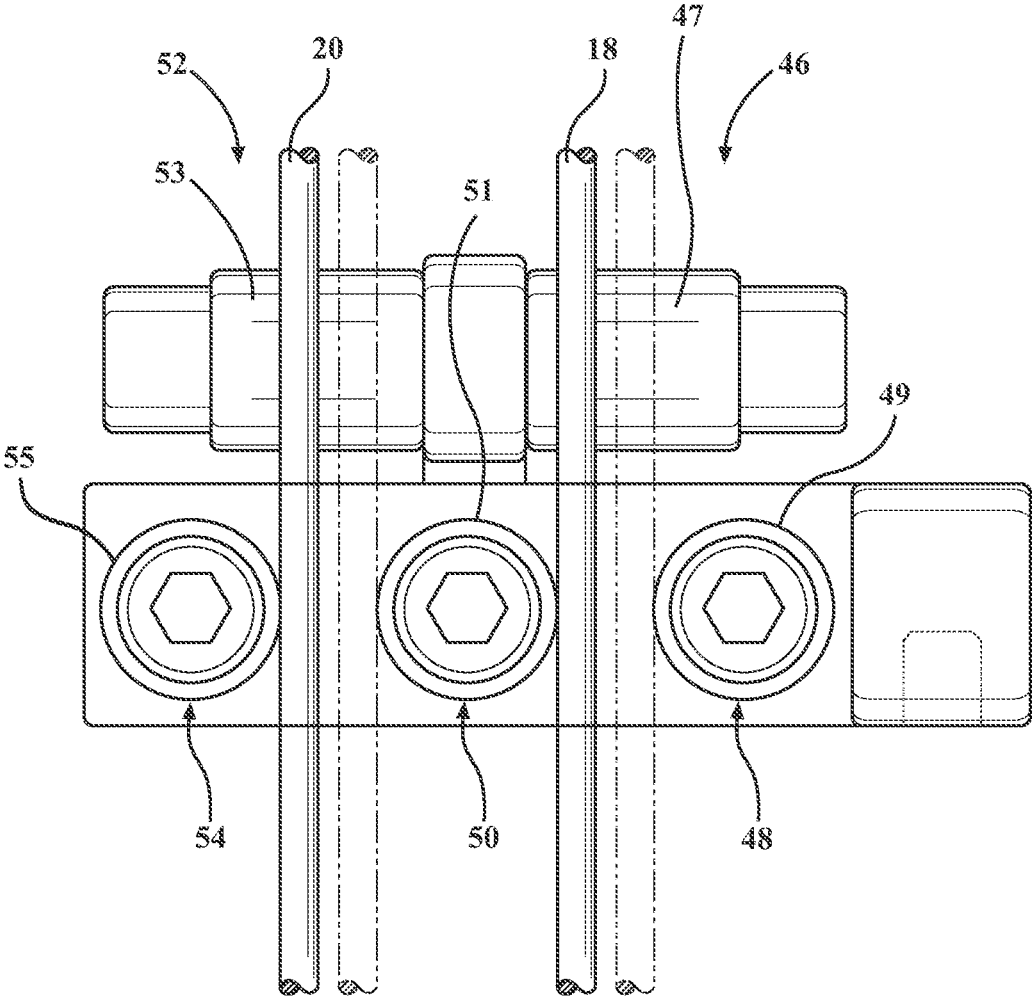
FIG. 5 is a side view of the first embodiment of the cable guard with cables of the compound bow shown in the drawn position and with the brace position in broken lines.
Figure 6:
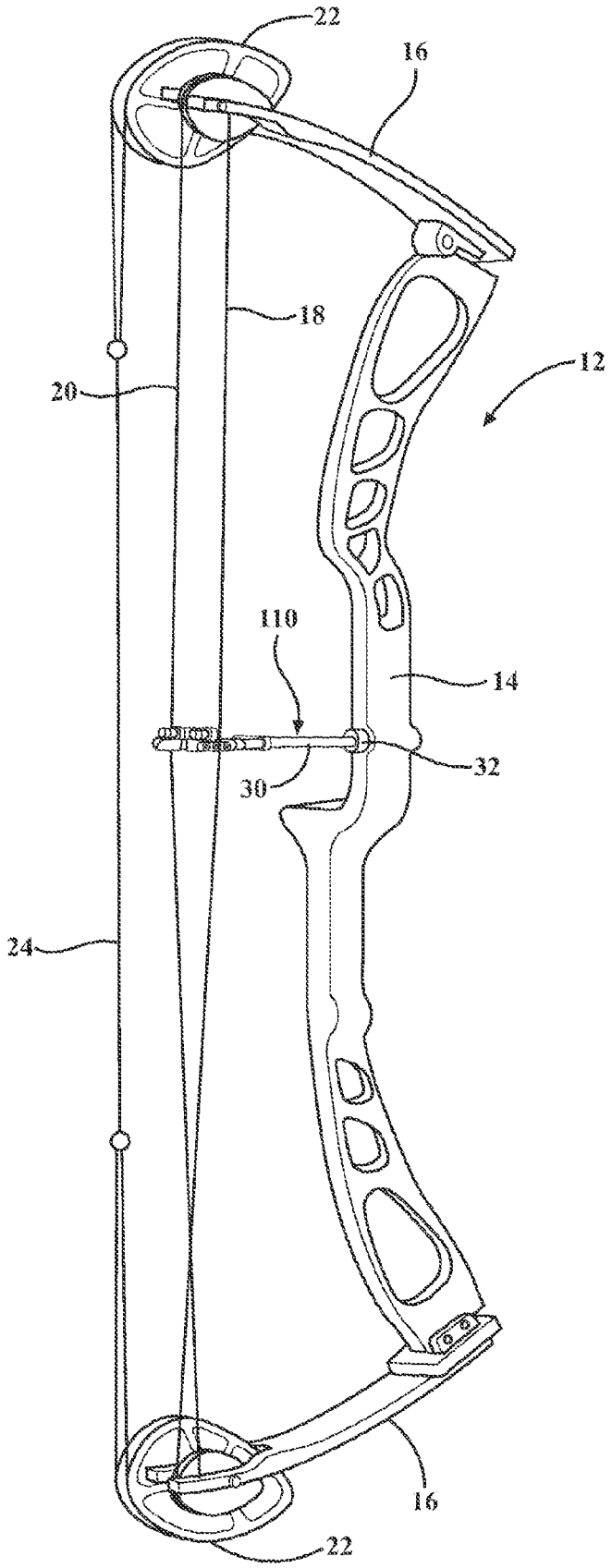
FIG. 6 is a perspective view of a compound bow in a brace position and including a second embodiment of the cable guard.

As best shown in FIGS. 3A, 3B, and 5, the first cable 18 contacts the bearing surface 47 of the first bearing 46 between the bearing surfaces 49, 51 of the second bearing 48 and the third bearing 50. The second cable 20 contacts the bearing surface 53 of the fourth bearing 52 between the bearing surfaces 51, 55 of the third bearing 50 and the fifth bearing 54. In the configuration where the bearings are rotatable, as the string 24 is moved between the brace position and the drawn position, the cables 18, 20 rotate the first bearing 46 and the second bearing 48. This rotation reduces friction and associated wear on the cables 18, 20.

When the bow 12 is in the brace position, the first cable 18 is biased toward the second bearing 48 and the second cable 20 is biased toward the third bearing 50. As the string 24 is moved to the drawn position, the geometry of the limbs 16 change to bias the first cable 18 toward the third bearing 50 and to bias the second cable 20 toward the fifth bearing 54.

With reference to FIG. 5, the bearing surfaces 49, 51 of the second bearing 48 and the third bearing 50 are typically spaced from each other a distance greater than the diameter of the first cable 18. The bearing surfaces 51, 55 of the third bearing 50 and the fifth bearing 54 are typically spaced from each other a distance greater than the diameter of the second cable 20. In such a configuration, the first cable 18 and the second cable 20 move fore and aft relative to the cable guard 10 as the string 24 is moved from the brace position to the drawn position.

Specifically, when the string 24 is in the brace position, the first cable 18 contacts the bearing surface 49 of the second bearing 48 and the second cable 20 contacts the bearing surface 51 of the third bearing 50. During movement of the string 24 from the brace position to the drawn position, the first cable 18 slides from the second bearing 48 to the third bearing 50 along the bearing surface 47 of the first bearing 46 and the second cable 20 slides from the third bearing 50 to the fifth bearing 54 along the bearing surface 53 of the fourth bearing 52. Alternatively, the bearing surfaces 49, 51 of the second bearing 48 and the third bearing 50 are spaced from each other a distance approximately equal to the diameter of the first cable 18 and the bearing surfaces 51, 55 of the third bearing 50 and the fifth bearing 54 are spaced from each other a distance approximately equal to the diameter of the second cable 20. In any event, in the configuration where the bearings are rotatable, the cables 18, 20 rotate any of the bearings that the cables 18, 20 contact during movement between the brace position and the drawn position and this rotation reduces friction and associated wear on the cables 18, 20.

Figure 4:
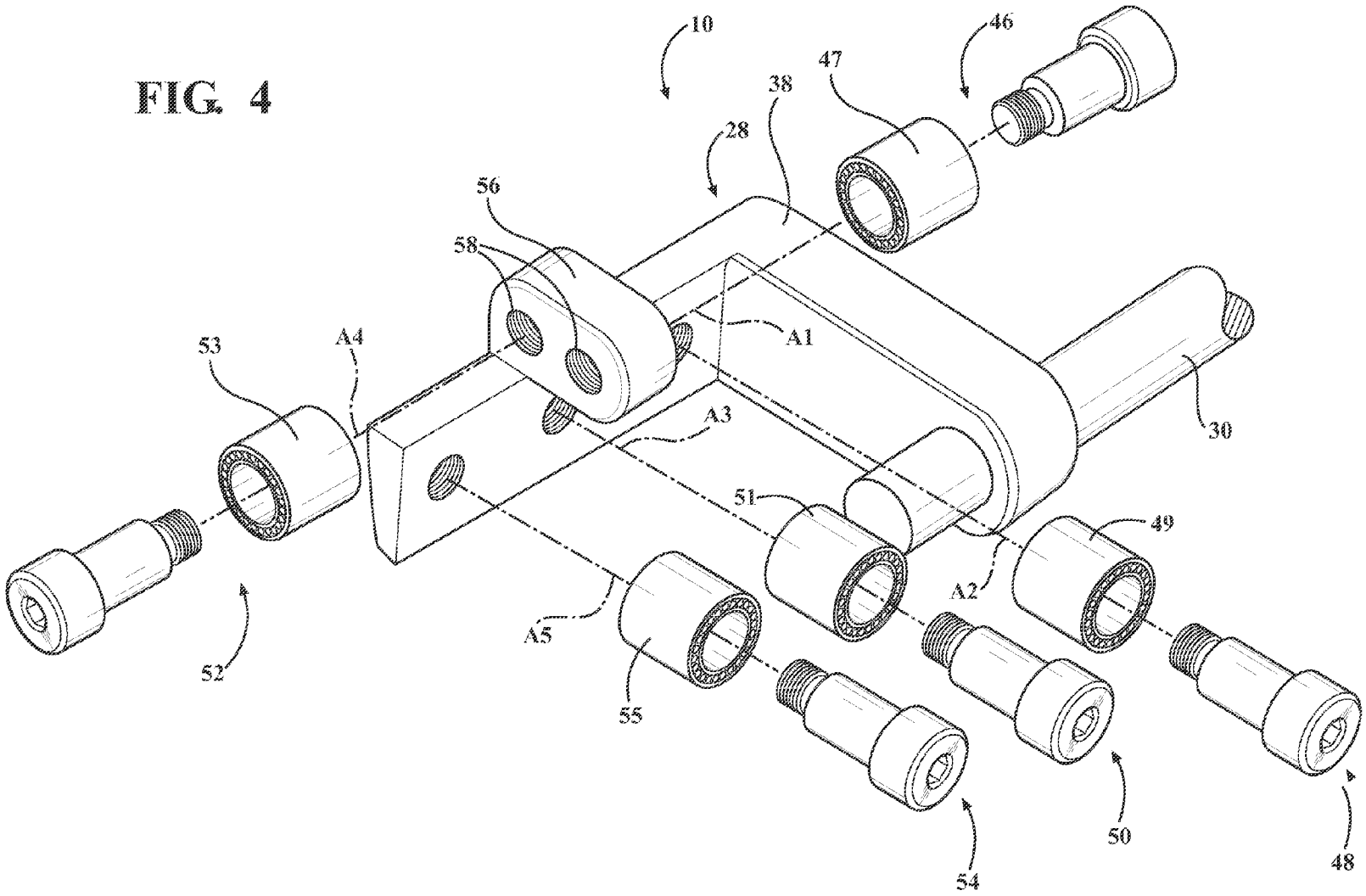
FIG. 4 is an exploded view of the first embodiment of the cable guard.

With reference to FIG. 4, the frame 28 includes an extension 56 extending from the base 38. The first bearing 46 and the fourth bearing 52 are assembled to the extension 56. Specifically, the extension 56 defines a pair of holes 58 receiving the first bearing 46 and the fourth bearing 52. The first bearing 46 and the fourth bearing 52 can be interchangeably engaged with the holes 58. In other words, the first bearing 46 can engage either hole 58 and the fourth bearing 52 can engage the other hole 58. The first bearing 46 and the fourth bearing 52 can engage the holes 58 in any suitable fashion.

As shown in FIGS. 1 and 2, the first bearing 46 and the fourth bearing 52 are typically disposed above the second bearing 48, third bearing 50, and fifth bearing 54 when the cable guard 10 is assembled to the riser 14. Alternatively, the first bearing 46 and fourth bearing 52 can be disposed below the second bearing 48, third bearing 50, and fifth bearing 54.

Figure 3C:
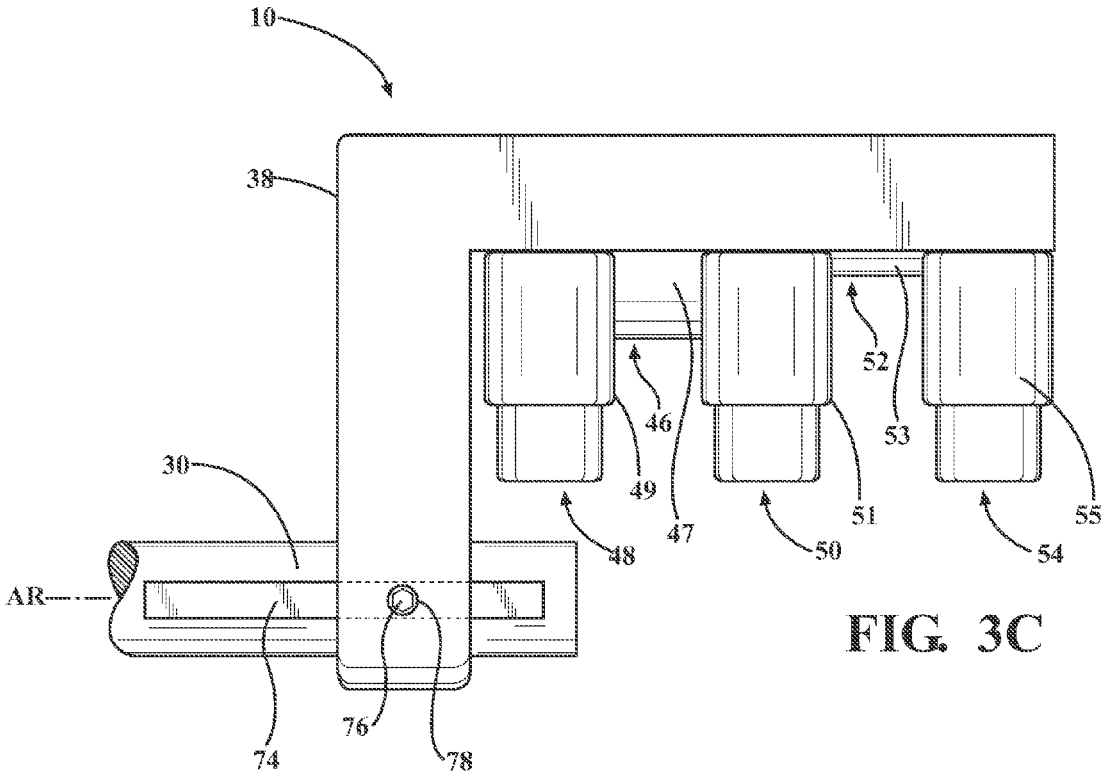
FIG. 3C is a bottom view of the cable guard of FIG. 3A.

With continued reference to the first embodiment, the base 38 may be adjustable relative to the rod 30. With reference to FIG. 3C, the rod 30, for example, may extend along an axis AR and the base 38 may be adjustable relative to the rod 30 along the axis AR. Specifically, the cable guard 10 may include a lock releasably fixing the base 38 to the rod 30 along the axis AR. For example, the rod 30 may define a flat 74, and the base 38 may support a set screw 76 engagable with the flat 74 for locking the base 38 along the rod 30. Specifically, the base 38 defines a threaded hole 78 that threadedly receives the set screw 76. The set screw 76 may be tightened to lock the base 38 to the rod 30 and may be loosened to unlock the base 38 for adjustment along the rod 38. Alternatively, the base 38 may be adjustable along the axis AR of the rod 30 in any suitable manner and the lock may be of any suitable type.

With reference to FIGS. 6-8, the second embodiment of the cable guard 110 includes a first bearing set 60 and a second bearing set 62. The rod 30 supports both the first bearing set 60 and the second bearing set 62 on the riser 14. The first bearing set 60 and the second bearing set 62 are typically minor images of each other. As shown in FIG. 6, the cable guard 110 deflects the first cable 18 to one side of the cable guard 110 and deflects the second cable 20 to the other side of the cable guard 110. The arrow 26 is loaded onto the riser 14 through a gap between the first cable 18 and the second cable 20.

Figure 7A:
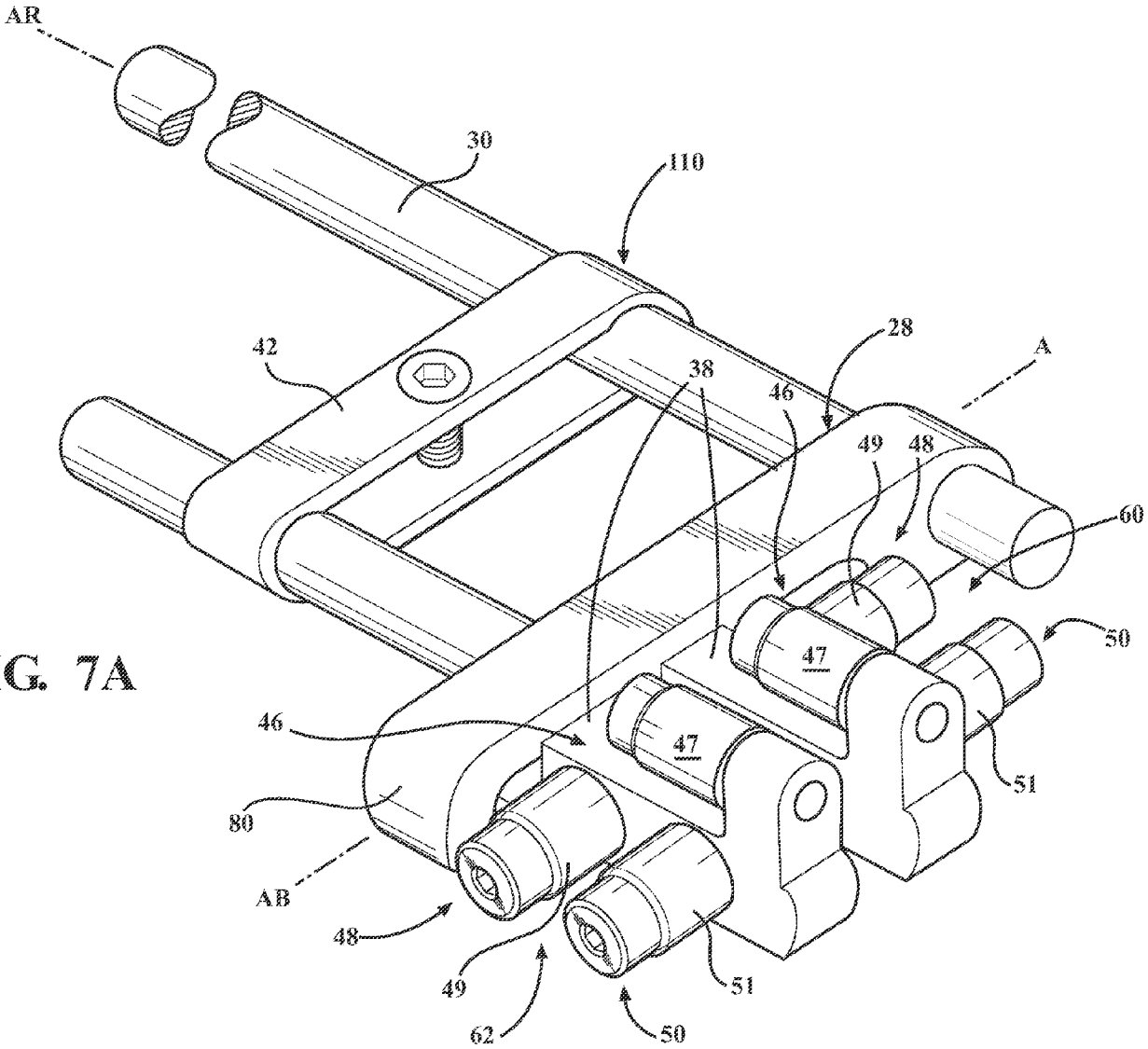
FIG. 7A is a perspective view of the cable guard of FIG. 6.
Figure 7B:
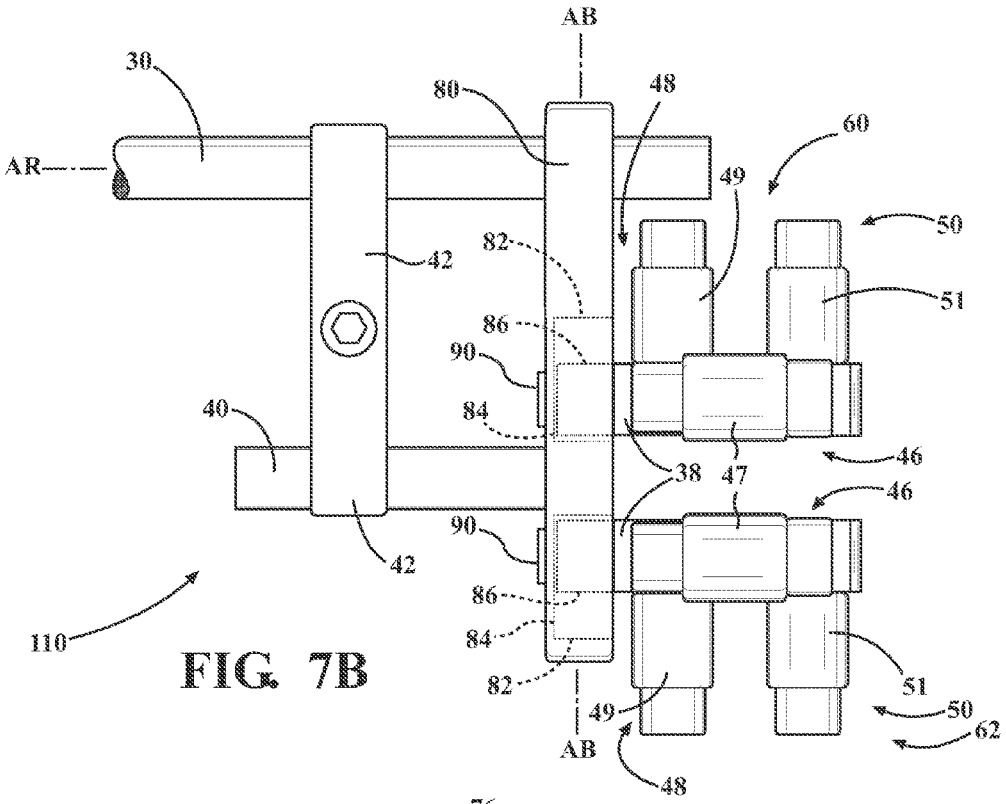
FIG. 7B is a top view of the cable guard of FIG. 7A
Figure 8:
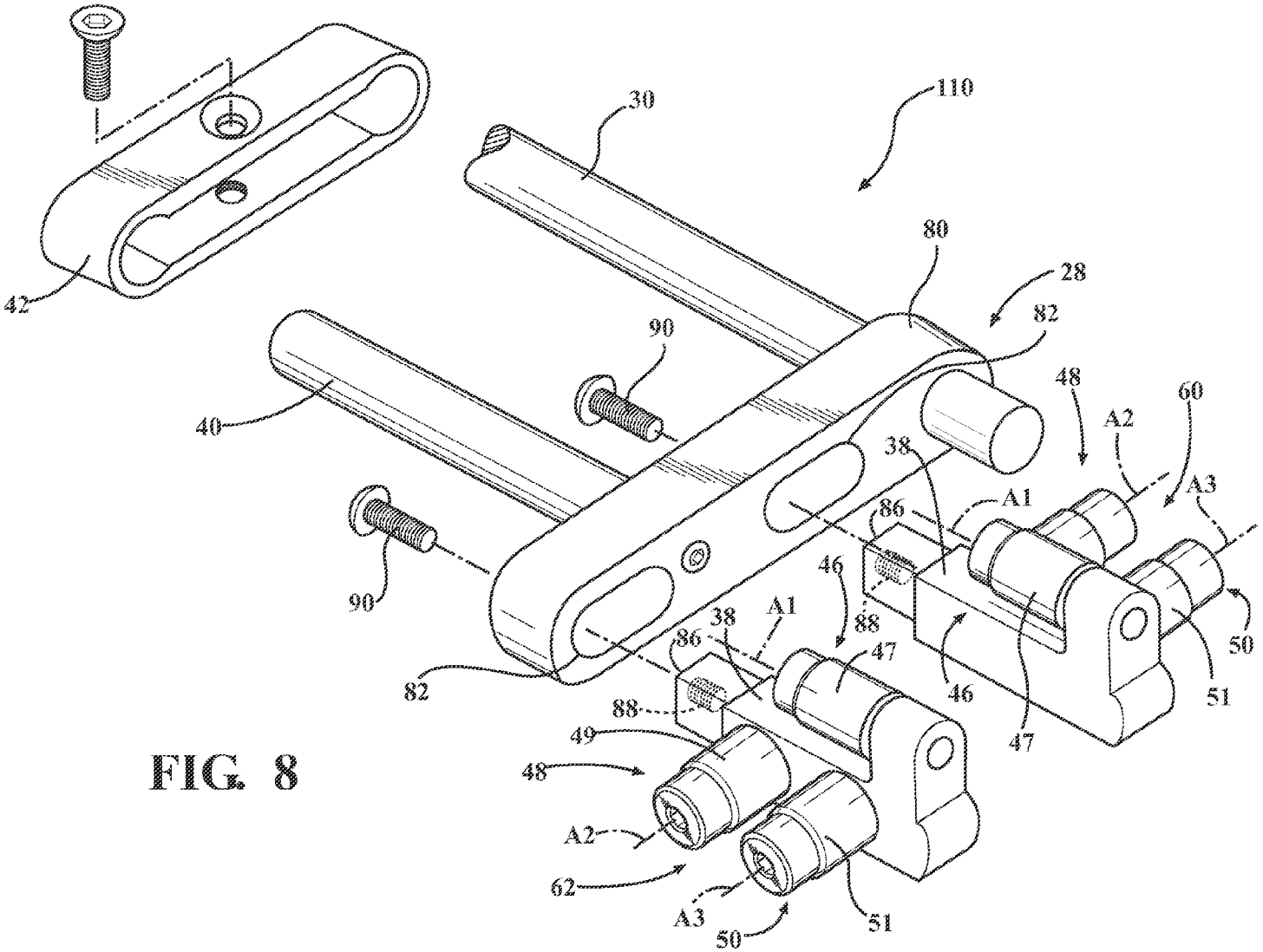
FIG. 8 is an exploded view of the second embodiment of the cable guard.

With reference to FIGS. 7A, 7B, and 8, the frame 28 includes a platform 80 and two bases 38 spaced from each other. One base 38 supports the first bearing set 60 and the other base 38 supports the second bearing set 62. As shown in FIG. 8, for example, the bases 38 can be connected to the platform 80 through a recess 82 and a slot 84 that allows for adjustment of the bases 38 relative to the platform 80, as set forth further below. Alternatively, the bases 38 can, for example, be connected to platform 80 through holes (not shown) that fix the bases 38 relative to the platform 80.

At least one of the two bases 38 may be adjusted relative to the frame 28 for adjusting the space between the bases 38. Specifically, the bases 38 may be spaced from each other along an axis AB and at least one of the bases 38 may be adjustable along the axis AB. The rod 30 may extend from the riser 14 along the axis AR, as set forth above, and the axis AB between the bases 38 may be perpendicular to the axis AR such that the bases 38 may be adjusted along the axis AB to accommodate various spacing between the first cable 18 and the second cable 20. In the configuration shown in FIGS. 7A-8, both bases 38 are adjustable relative to the frame 28.

With reference to FIGS. 7B and 8, each base 38 may define a projection 86 and the frame 28 may define the recesses 82 configured to slidably receive the projection 86. The recesses 82 are elongated along the axis AB so that each base 38 may slide along the recesses 82 to a desired position.

The frame 28 may define the slot 84 along each recess 82. As shown in FIG. 8, each base 38 may define a threaded hole 88 for aligning with the slot 84, and a threaded fastener 90 may extend through the slot 84 and engage the base 38 for locking the base 38 in position along the slot 84. A head of the threaded fastener 90 may pinch the frame 28 between the head and the base 38. The threaded fastener 90 may be tightened relative to the base 28 to lock the base 38 in position and may be loosened relative to the base 38 to unlock the base 38 for adjustment along the axis AB.

The first bearing set 60 and the second bearing set 62 each include a first bearing 46, a second bearing 48, and a third bearing 50. The description of the first bearing 46, second bearing 48, and third bearing 50 above for the first embodiment, including relative positioning, is also applicable to the first bearing 46, second bearing 48, and third bearing 50 of both the first bearing set 60 and second bearing set 62 of the second embodiment.

The first cable 18 contacts the bearing surface 47 of the first bearing 46 of the first bearing set 60 and the second cable 20 contacts the bearing surface 47 of the first bearing 46 of the second bearing set 62. In the configuration where the bearings are rotatable, as the string 24 is moved between the brace position and the drawn position, the cables 18, 20 rotate the first bearing 46 of the first bearing set 60 and the second bearing set 62. This rotation reduces friction and associated wear on the cables 18, 20.

When the string 24 is in the brace position, the first cable 18 is biased toward the second bearing 48 of the first bearing set 60 and the second cable 20 is biased toward the second bearing 48 of the second bearing set 62. As the string 24 is moved to the drawn position, the geometry of the limbs 16 change to bias the first cable 18 toward the third bearing 50 and to bias the second cable 20 toward the fifth bearing 54.

With reference to FIGS. 7A and 7B, the bearing surfaces 49, 51 of the second bearing 48 and the third bearing 50 of the first bearing set 60 and the second bearing set 62, respectively, are typically spaced from each other a distance greater than the diameters of the first cable 18 and second cable 20 (not shown in FIGS. 7A and 7B), respectively. In such a configuration, the first cable 18 and the second cable 20 move fore and aft relative to the cable guard 110 as the string 24 is moved between the brace position and the drawn position.

Specifically, when the string 24 is in the brace position, the first cable 18 and the second cable 20 contact the bearing surface 47 of the first bearing 46 of the first bearing set 60 and the second bearing set 62, respectively. During movement of the string 24 from the brace position to the drawn position, the first cable 18 and the second cable 20 slide from the respective second bearing 48 to the third bearing 50 along the bearing surface 47 of the first bearing 46. Alternatively, the bearing surfaces 49, 51 of the second bearing 48 and the third bearing 50 of the first bearing set 60 and the second bearing set 62 are spaced from each other a distance approximately equal to the diameter of the first cable 18 and the second cable 20, respectively. In any event, in the configuration where the bearings are rotatable, the cables 18, 20 rotate any of the bearings that the cables 18, 20 contact during movement between the brace position and the drawn position and this rotation reduces friction and associated wear on the cables 18, 20.

The second embodiment of the cable guard 110 is assembled to the riser 14 by inserting the cable guard 110 between the first cable 18 and the second cable 20. The rod 30 is coupled to the riser 14, e.g., the rod 30 is inserted into the riser 14, and the first bearing set 60 and second bearing set 62 are inserted between the first cable 18 and the second cable 20. The frame 28 is initially positioned relative to the riser 14 in a position rotated relative to the final position shown in FIG. 6 to aid in the ease of insertion of the first bearing set 60 and the second bearing set 62 between the first cable 18 and the second cable 20. The first cable 18 is inserted between the second bearing 48 and the third bearing 50 of the first bearing set 60 and the second cable 20 is inserted between the second bearing 48 and the third bearing 50 of the second bearing set 62. The frame 28 is then rotated relative to the riser 14 to the position shown in FIG. 6 such that the first bearing 46 of the first bearing set 60 and the first bearing 46 of the second bearing set 62 force the first cable 18 and the second cable 20 in opposite directions.

Figure 7C:
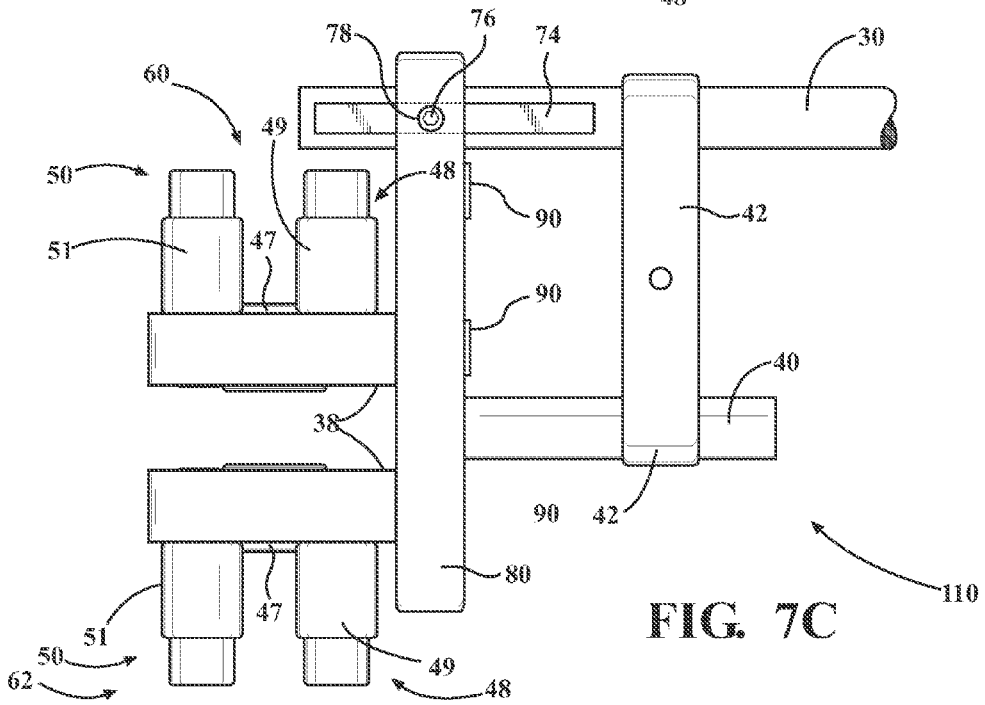
FIG. 7C is a bottom view of the cable guard of FIG. 7A.

With continued reference to the second embodiment, the platform 80 may be adjustable relative to the rod 30. With reference to FIG. 7C, the platform 80 may support the set screw 76 that is engagable with the flat 74 for locking the platform 80 along the rod 30. Specifically, the platform 80 defines the threaded hole 78 that threadedly receives the set screw 76. The set screw 76 may be tightened to lock the platform 80 to the rod 30 and may be loosened to unlock the platform 80 for adjustment along the rod 38. Alternatively, the platform 80 may be adjustable along the axis AR of the rod 30 in any suitable manner.

Figure 10:
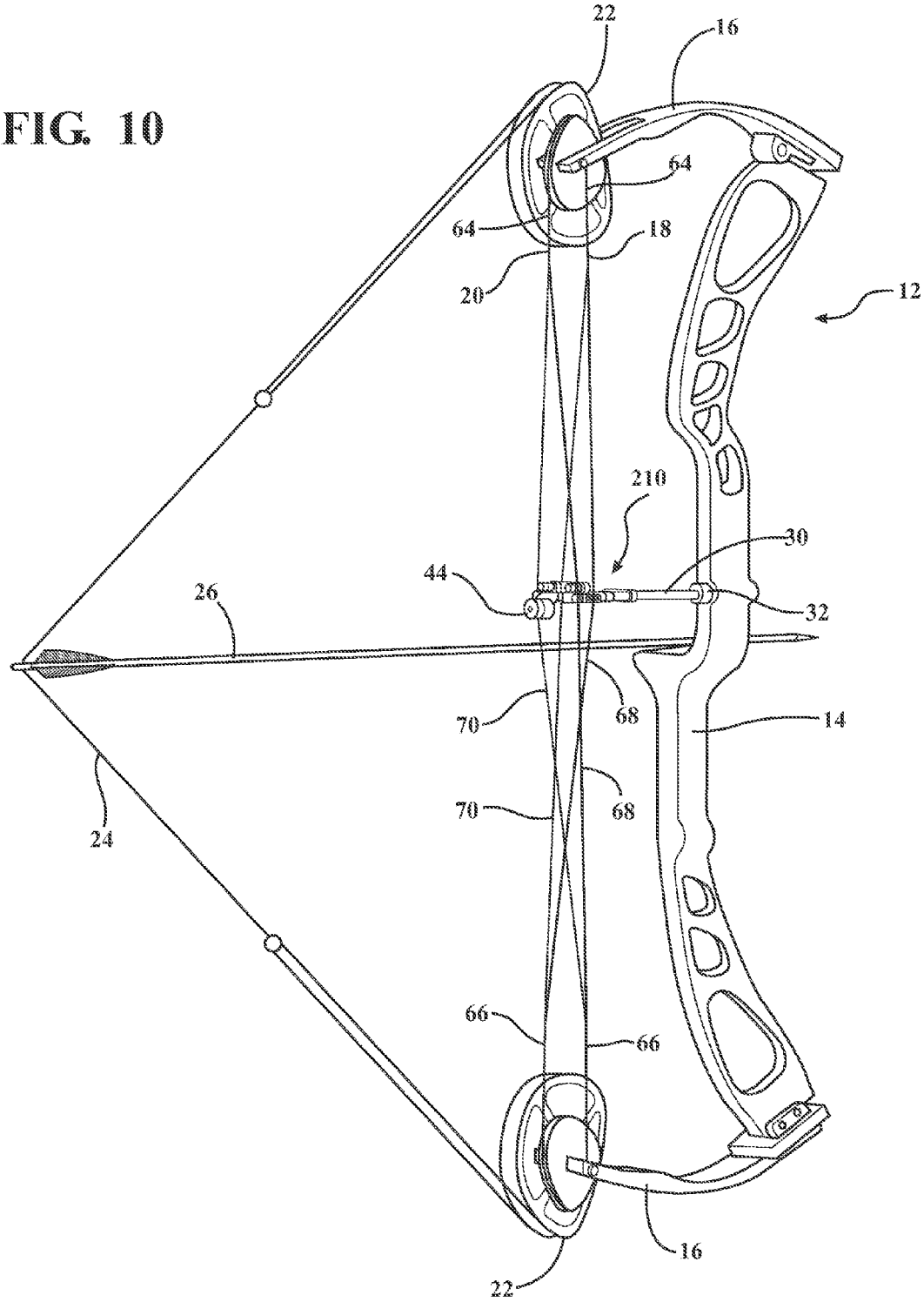
FIG. 10 is a perspective view of the compound bow of FIG. 9 in the drawn position.

With reference to FIGS. 9-12, the third embodiment of the cable guard 210 includes a first bearing set 260 and a second bearing set 262. The rod 30 supports both the first bearing set 260 and the second bearing set 262 on the riser 14. The first bearing set 260 and the second bearing set 262 are typically mirror images of each other. As shown in FIGS. 9 and 10, the cable guard 210 deflects split portions of the first cable 18 to opposite sides of the cable guard 210 and deflects split portions of the second cable 20 to opposite sides of the cable guard 210. The arrow 26 is loaded onto the riser 14 between the split portions of the first cable 18 and between the split portions of the second cable 20.

Specifically, as shown in FIGS. 9 and 10, the first cable 18 and the second cable 20 each include an upper unsplit portion 64 for attachment to the limb 16 or pulley 22 and a lower unsplit portion 66 for attachment to the limb 16 or pulley 22. The first cable 18 and the second cable 20 each include a first split portion 68 and a second split portion 70 extending between the upper unsplit portion 64 and the lower unsplit portion 66. The first split portion 68 may be engaged with either one of the bearing sets 260, 262 and the second split portion 70 may be engaged with the other one of the bearing sets 260, 262.

Figure 11B:
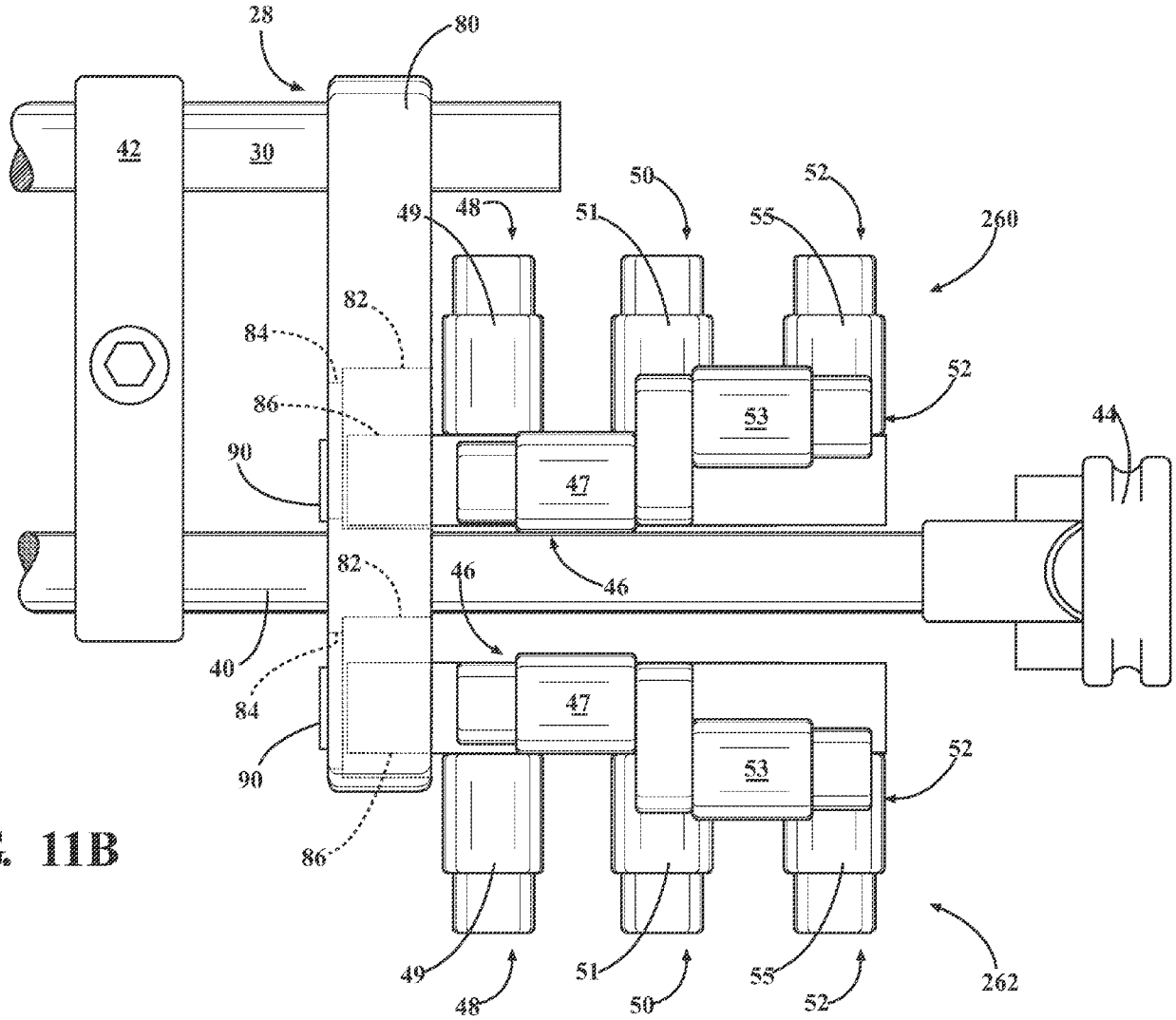
FIG. 11B is a top view of the cable guard of FIG. 11A.
Figure 11C:
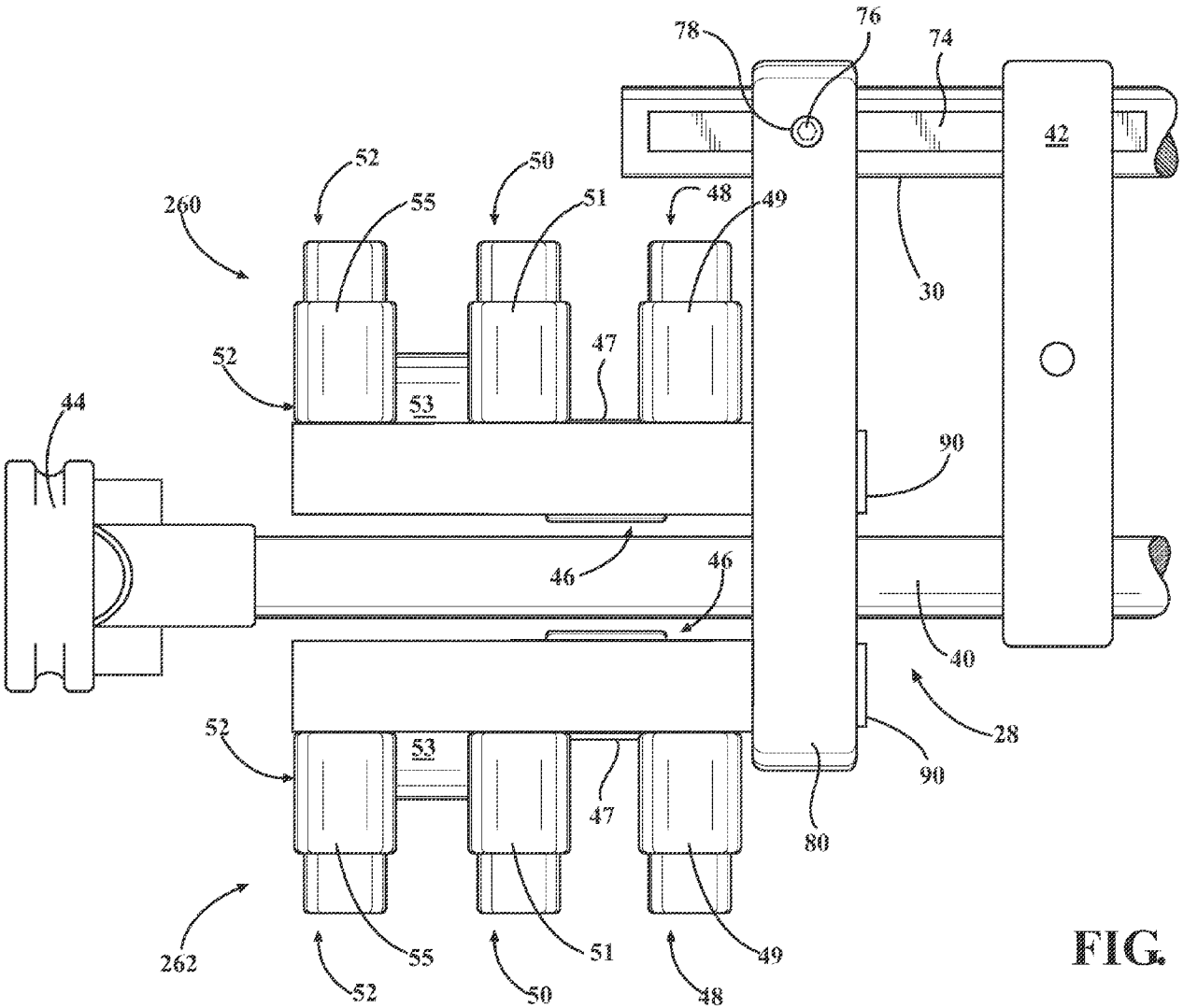
FIG. 11C is a bottom view of the cable guard of FIG. 11A.
Figure 12:
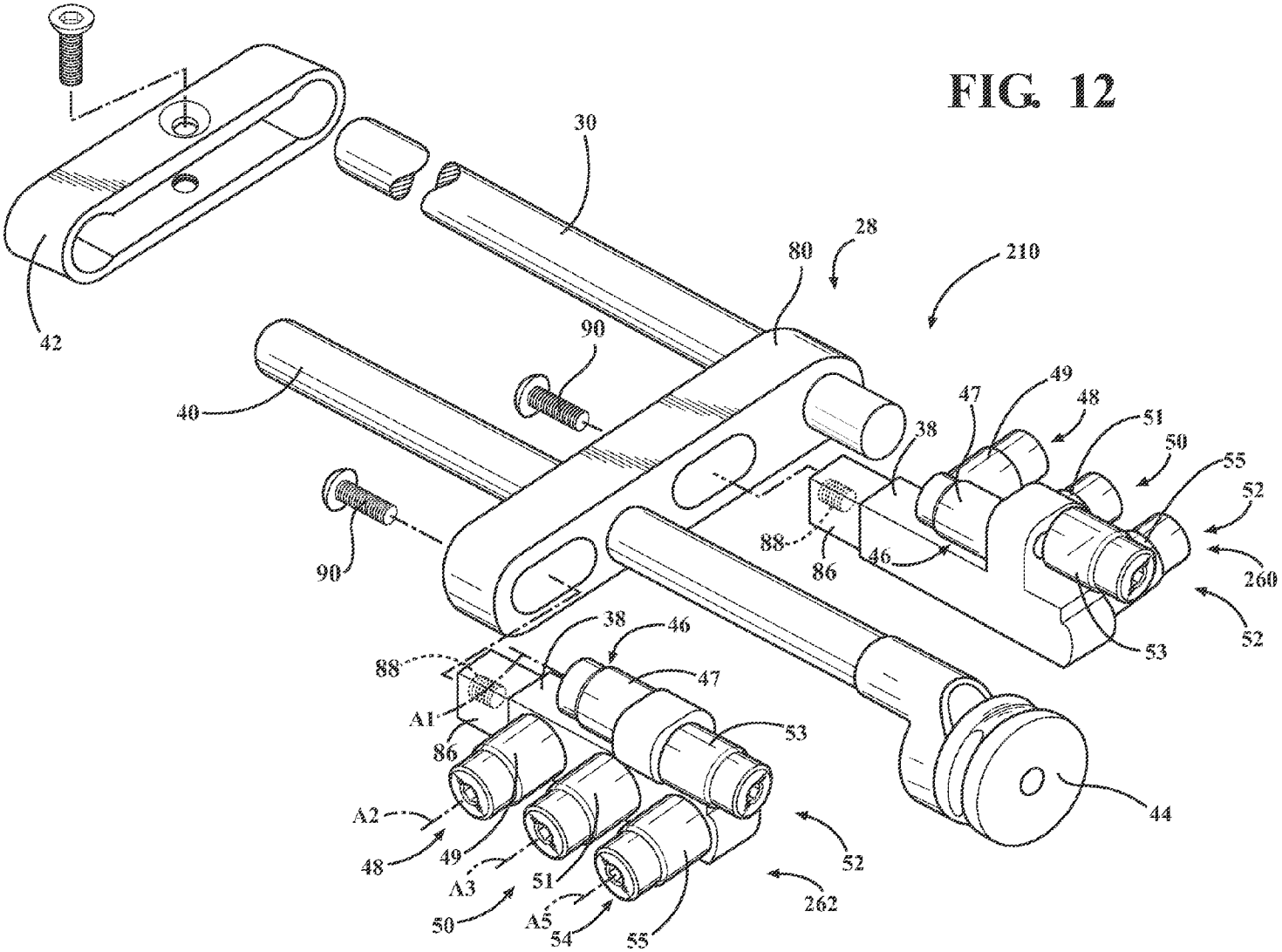
FIG. 12 is an exploded view of the third embodiment of the cable guard.

With reference to FIGS. 11A-12, the frame 28 includes two bases 38 spaced from each other. One base 38 supports the first bearing set 260 and the other base 38 supports a second bearing set 262. The string suppressor 44 extends between the first bearing set 260 and the second bearing set 262. As shown in FIG. 12, similar to the second embodiment, for example, the bases 38 can be connected to the platform 80 through the recess 82 and the slot to allow for adjustment of the bases 38 relative to the platform 80, as set forth further below. Alternatively, the bases 38 can, for example, be connected to the platform 80 through holes (not shown) that fix the bases 38 relative to the platform 80.

At least one of the two bases 38 may be adjusted relative to the frame 28 for adjusting the space between the bases 38. Specifically, the bases 38 may be spaced from each other along the axis AB and at least one of the bases 38 may be adjustable along the axis AB. The rod 30 may extend from the riser 14 along the axis AR, as set forth above, and the axis AB between the bases 38 may be perpendicular to the axis AR such that the bases 38 may be adjusted along the axis AB to accommodate various spacing between the first cable 18 and the second cable 20. In the configuration shown in FIGS. 11A-12, both bases 38 are adjustable relative to the frame 28.

With reference to FIGS. 11B and 12, each base 38 may define the projection 86 and the frame 28 may define the recesses 82 configured to slidably receive the projection 86. The recesses 82 are elongated along the axis AB so that each base 38 may slide along the recesses 82 to a desired position.

The frame 28 may define the slot 84 along each recess 82. As shown in FIG. 12, each base 38 may define the threaded hole 88 for aligning with the slot 84, and the threaded fastener 90 may extend through the slot 84 and engage the base 38 for locking the base 38 in position along the slot 84. The head of the threaded fastener 90 may pinch the frame 28 between the head and the base 38. The threaded fastener 90 may be tightened relative to the base 28 to lock the base 38 in position and may be loosened relative to the base 38 to unlock the base 38 for adjustment along the axis AB.

The first bearing set 260 and the second bearing set 262 each include a first bearing 46, a second bearing 48, a third bearing 50, a fourth bearing 52, and a fifth bearing 54. The description of the first bearing 46, second bearing 48, third bearing 50, fourth bearing 52, and fifth bearing 54 above for the first embodiment, including relative positioning, is also applicable to the first bearing 46, second bearing 48, third bearing 50, fourth bearing 52, and fifth bearing 54 of both the first bearing set 260 and second bearing set 262 of the third embodiment.

The first split portion 68 of the first cable 18 contacts the bearing surface 47 of the first bearing 46 of the first bearing set 260 and the second split portion 70 of the first cable 18 contacts the bearing surface 47 of the first bearing 46 of the second bearing set 262. Similarly, the first split portion 68 of the second cable 20 contacts the bearing surface 53 of the fourth bearing 52 of the first bearing set 260 and the second split portion 70 of the second cable 20 contacts the bearing surface 53 of the fourth bearing 52 of the second bearing set 262. In the configuration where the bearings rotate, as the string 24 is moved between the brace position and the drawn position, the cables 18, 20 rotate the first bearing 46 and the fourth bearing 52 of the first bearing set 260 and the second bearing set 262. This rotation reduces friction and associated wear on the cables 18, 20.

When the string 24 is in the brace position, the first split portion 68 of the first cable 18 is biased toward the second bearing 48 of the first bearing set 260 and the second split portion 70 of the first cable 18 is biased toward the second bearing 48 of the second bearing set 262. Similarly, when the string 24 is in the brace position, the first split portion 68 of the second cable 20 is biased toward the third bearing 50 of the first bearing set 260 and the second split portion 70 of the first cable 18 is biased toward the second bearing 48 of the second bearing set 262. As the string 24 is moved to the drawn position, the geometry of the limbs 16 change to bias the first split portion 68 of the first cable 18 toward the third bearing 50 of the first bearing set 260 and to bias the second split portion 70 of the first cable 18 toward the third bearing 50 of the second bearing set 262. Likewise, as the string 24 is moved to the drawn position, the first split portion 68 of the second cable 20 is biased toward the fifth bearing 54 of the first bearing set 260 and the second split portion 70 of the second cable 20 is biased toward the fifth bearing 54 of the second bearing set 262.

Similar to FIG. 5 discussed above, the bearing surfaces 49, 51 of the second bearing 48 and the third bearing 50 of the first bearing set 260 and the second bearing set 262 are typically spaced from each other a distance greater than the diameter of the first split portion 68 and the second split portion 70, respectively, of the first cable 18. The bearing surfaces 51, 55 of the third bearing 50 and the fifth bearing 54 of the first bearing set 260 and the second bearing set 262 are typically spaced from each other a distance greater than the diameter of the first split portion 68 and the second split portion 70, respectively, of the second cable 20. In such a configuration, the first split portions 68 and the second split portions 70 can move fore and aft relative to the cable guard 210 as the string 24 is moved from the brace position to the drawn position.

Specifically, when the string 24 is in the brace position, the first split portion 68 of the first cable 18 contacts the bearing surface 49 of the second bearing 48 of the first bearing set 260 and the second split portion 70 of the first cable 18 contacts the bearing surface 49 of the second bearing 48 of the second bearing set 262. During movement of the string 24 from the brace position to the drawn position, the first split portion 68 and the second split portion 70 slide from the respective second bearing 48 to the third bearing 50 along the bearing surface 47 of the first bearing 46. Likewise, when the string 24 is in the brace position, the first split portion 68 of the second cable 20 contacts the bearing surface 51 of the third bearing 50 of the first bearing set 260 and the second split portion 70 of the second cable 20 contacts the bearing surface 51 of the third bearing 50 of the second bearing set 262. During movement of the string 24 from the brace position to the drawn position, the first split portion 68 and the second split portion 70 slide from the respective third bearing 50 to the fifth bearing 54 along the bearing surface 53 of the fourth bearing 52. Alternatively, the bearing surfaces 49, 51 of the second bearing 48 and the third bearing 50 are spaced from each other a distance approximately equal to the diameter of the first split portions 68 and the bearing surfaces 51, 55 of the third bearing 50 and the fifth bearing 54 are spaced from each other a distance approximately equal to the diameter of the second split portions 70. In any event, in the configuration where the bearings are rotatable, the cables 18, 20 rotate any of the bearings that the cables 18, 20 contact during movement between the brace position and the drawn position and this rotation reduces friction and associated wear on the cables 18, 20.

The third embodiment of the cable guard 210 is assembled to the riser 14 by inserting the cable guard 210 between the first split portion 68 and the second split portion 70 of the first cable 18 and between the first split portion 68 and the second split portion 70 of the second cable 20. The frame 28 is coupled to the riser 14 and the first bearing set 260 and second bearing set 262 are inserted between the first split portion 68 and second split portion 70 of the first cable 18 and between the first split portion 68 and second split portion 70 of the second cable 20. The frame 28 is initially inserted into the riser 14 in a position rotated relative to the final position shown in FIG. 9 to aid in the ease of insertion of the first bearing set 260 and the second bearing set 262 between the split portions 68, 70. When the split portions 68, 70 are placed between the appropriate bearings, the frame 28 is rotated relative to the riser 14 to the position shown in FIG. 9 such that the first bearing 46 of the first bearing set 260 and the first bearing 46 of the second bearing set 262 force the first split portion 68 and the second split portion 70 in opposite directions.

With continued reference to the third embodiment, the platform 80 may be adjustable relative to the rod 30. With reference to FIG. 11C, the platform 80 may support the set screw 76 that is engagable with the flat 74 for locking the platform 80 along the rod 30. Specifically, the platform 80 defines the threaded hole 78 that threadedly receives the set screw 76. The set screw 76 may be tightened to lock the platform 80 to the rod 30 and may be loosened to unlock the platform 80 for adjustment along the rod 38. Alternatively, the platform 80 may be adjustable along the axis AR of the rod 30 in any suitable manner.

With reference to FIGS. 13-15B, for example, the first cable 18 and the second cable 20 are each formed of a plurality of strands 72 twisted together. The first cable 18 and second cable 20 can include any suitable number of strands 72. Regardless of the number of strands 72, all strands 72 are twisted together at the upper unsplit portion 64 and the lower unsplit portion 66. As shown in FIG. 13, the strands 72 are divided between the first split portion 68 and the second split portion 70 between the upper unsplit portion 64 and the lower unsplit portion 66. In other words, some of the strands 72, e.g., half of the strands 72, extend along the first split portion 68 between the upper split portion 64 and the lower split portion 66, and the rest of the strands 72, e.g., the other half of the strands 72, extend along the second split portion 70 between the upper split portion 64 and the lower split portion 66. As shown in FIG. 13, a binder 92, e.g., tape, wire, string, etc., may be wound around the cable 18, 20 to separate the upper unsplit portion 64 and the lower unsplit portion 66 from the first and second split portions 68, 70.

The strands 72 of the first split portion 68 may be twisted together in one direction and the strands 72 of the second split portion 70 may be twisted together in an opposite direction. For example, the strands 72 of one of the portions 68, 70 may be twisted together in a left-handed direction and the strands 72 of the other one of the portions 68, 70 may be twisted together in right-handed direction. As such, as the first split portion 68 and the second split portion 70 may unwind evenly relative to each other while sliding along the bearings 46, 52.

With reference to FIGS. 14-15B, each strand 72 includes a plurality of fibers 94 twisted together. Each strand 72 may include any suitable number of fibers 94. One strand 72 is separated apart into individual fibers 94 for illustrative purposes in FIG. 14.

Each fiber 94 may be twisted. In other words, each individual fiber 94, before being assembled into the strand 72, may be twisted. For example, each fiber 94 may be twisted in a right-handed direction or may be twisted in a left-handed direction.

As set forth above, the strands 72 of one of the first and second split portions 68, 70 may be twisted together in the left-handed direction and the strands 72 of the other of the first and second split portions 68, 70 may be twisted together in the right-handed direction. In such a configuration, the fibers 94 of the strands 72 twisted together in the left-handed direction may be twisted in the left-handed direction, i.e., each individual fiber 94 may be twisted in the left-handed direction. Similarly, in such a configuration, the fibers 94 of the strands 72 twisted together in the right-handed direction may be twisted in the right-handed direction, i.e., each individual fiber 94 may be twisted in the right-handed direction.

For example, the strands 72 of the first split portion 68 may be formed of fibers 94 each twisted in a left-handed direction, and the strands 72 of the second split portion 70 may be twisted together in a left-handed direction. In such a configuration, the strands 72 of the first split portion 68 may be formed of fibers 94 each twisted in the left-handed direction, and the strands 72 of the second split portion 70 may be twisted together in a right-handed direction.

As another example, the fibers 94 of the strands 72 twisted together in the left-handed direction may be twisted in the right-handed direction, i.e., each individual fiber 94 may be twisted in the right-handed direction. Similarly, in such a configuration, the fibers 94 of the strands 72 twisted together in the right-handed direction may be twisted in the left-handed direction, i.e., each individual fiber 94 may be twisted in the left-handed direction. For example, the strands 72 of the first split portion 68 may be formed of fibers 94 each twisted in a right-handed direction, and the strands 72 of the first split portion 68 may be twisted together in a left-handed direction. In such a configuration, the strands 72 of the second split portion 70 may be formed of fibers 94 each twisted in a left-handed direction, and the strands 72 of the second split portion 68 may be twisted together in a right-handed direction.

Alternatively, each fibers 94 of each strand 72 that form both the first and second split portions 68, 70 may be twisted in a common direction.

With reference to FIG. 16, the fourth embodiment of the cable guard 310 includes a first bearing set 360 and a second bearing set 362. A first rod 331 supports the first bearing set 360 on the riser 314 and a second rod 333 supports the second bearing set 362 on the riser 314. The first bearing set 360 and the second bearing set 362 are typically mirror images of each other. As shown in FIG. 14, the cable guard 310 deflects the first cable 18 to one side of the cable guard 310 and deflects the second cable 20 to the other side of the cable guard 310. The riser 314 defines a slot 396 through which the arrow 26 (not shown in FIG. 16) is loaded and shot. The arrow 26 is loaded into the slot 396 of the riser 14 through a gap between the first cable 18 and the second cable 20.

The bases 38 may be adjustable relative to the rods 331, 333. For example, the bases 38 may support the lock releasably fixing the respective base 38 to the respective rod 331, 333 along the axis AR, e.g., the rods 331, 333 may each define flats 74 similar to those described above. In such a configuration, each base 38 may support the set screw 76 that is engagable with the flat 74 for locking the bases 38 along the rods 331, 333. Alternatively, as set forth above, the bases 38 may be adjustable along the axes AR of the rods 331, 333 in any suitable manner and the lock may be of any suitable type.

As shown in FIG. 16, the first bearing set 60 and the second bearing set 62 each include a first bearing 46, a second bearing 48, and a third bearing 50. The description of the first bearing 46, second bearing 48, and third bearing 50 above for the first embodiment, including relative positioning, is also applicable to the first bearing 46, second bearing 48, and third bearing 50 of both the first bearing set 60 and second bearing set 62 of the second embodiment.

The first cable 18 contacts the bearing surface 47 of the first bearing 46 of the first bearing set 60 and the second cable 20 contacts the bearing surface 47 of the first bearing 46 of the second bearing set 62. In the configuration where the bearings are rotatable, as the string 24 is moved between the brace position and the drawn position, the cables 18, 20 rotate the first bearing 46 of the first bearing set 60 and the second bearing set 62. This rotation reduces friction and associated wear on the cables 18, 20.

When the string 24 is in the brace position, the first cable 18 is biased toward the second bearing 48 of the first bearing set 60 and the second cable 20 is biased toward the second bearing 48 of the second bearing set 62. As the string 24 is moved to the drawn position, the geometry of the limbs 16 change to bias the first cable 18 toward the third bearing 50 and to bias the second cable 20 toward the fifth bearing 54.

With continued reference to FIG. 16, the bearing surfaces 49, 51 of the second bearing 48 and the third bearing 50 of the first bearing set 60 and the second bearing set 62, respectively, are typically spaced from each other a distance greater than the diameters of the first cable 18 and second cable 20, respectively. In such a configuration, the first cable 18 and the second cable 20 move fore and aft relative to the cable guard 110 as the string 24 is moved between the brace position and the drawn position.

Specifically, when the string 24 is in the brace position, the first cable 18 and the second cable 20 contact the bearing surface 47 of the first bearing 46 of the first bearing set 60 and the second bearing set 62, respectively. During movement of the string 24 from the brace position to the drawn position, the first cable 18 and the second cable 20 slide from the respective second bearing 48 to the third bearing 50 along the bearing surface 47 of the first bearing 46. Alternatively, the bearing surfaces 49, 51 of the second bearing 48 and the third bearing 50 of the first bearing set 60 and the second bearing set 62 are spaced from each other a distance approximately equal to the diameter of the first cable 18 and the second cable 20, respectively. In any event, in the configuration where the bearings are rotatable, the cables 18, 20 rotate any of the bearings that the cables 18, 20 contact during movement between the brace position and the drawn position and this rotation reduces friction and associated wear on the cables 18, 20.

As shown in FIGS. 17 and 18, in the alternative to the first bearing 46, the second bearing 48, and the third bearing 50, the fourth embodiment of the cable guard 310 may include two bearings 390 mounted to the base 38. Each of the bearings 390 may include a circumferential groove 392. At least one of the circumferential grooves 392 receive the cable 18, 20. The bearings 390 may trap the cable 18, 20 between the bearings 390 and the cable 18, 20 may contact one or both of the bearings 390 as the compound bow is moved between the brace position and the drawn position.

The bearings 390 may be of any suitable type. As shown in FIG. 18, for example, each bearing 390 may include a spindle (not numbered) mounted to the base 38 and a wheel (not numbered) rotatable relative to the spindle. The bearing 390 may include a suitable friction reducing connection between the wheel and the spindle.

The base 38 and bearings 390 shown in FIGS. 17 and 18 are designed for mounting to rod 333, however, another set (not shown) of the base 38 and bearings 390 is designed for mounting the rod 331. The base 38 and bearings 390 on the mounting rod 331 may be a minor image of the base 38 and bearings 390 on the mounting rod 333.

The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A cable guard comprising:

a rod extending along an axis;

a base releasably fixed to the rod and adjustable relative to the rod along the axis;

a lock releasably fixing the base to the rod along the axis;

a pair of bearings each supported by the base, wherein the pair of bearings are spaced from each other and oppose each other; and another bearing supported by the base and extending along an axis, and wherein the pair of bearings each extend along a respective axis transverse to the axis of the another bearing.

2. The cable guard as set forth in claim 1 wherein the lock includes a flat on the rod and a set screw on the base aligned with the flat.

3. The cable guard as set forth in claim 1 wherein each of the pair of bearings includes a circumferential groove.

4. The cable guard as set forth in claim 1 wherein the pair of bearings and the another bearing are each rotatable about their respective axes.

5. The cable guard as set forth in claim 1 wherein said axes of the pair of bearings are parallel to each other and the axis of the another bearing is perpendicular to the axes of the pair of bearings.

6. The cable guard as set forth in claim 1 wherein at least one of said pair of bearings and said another bearing is a needle bearing.

7. A compound bow comprising:

a riser;

a pair of limbs extending from opposing ends of said riser;

a cable extending between said limbs; and a cable guard including:

a rod supported by the riser and extending along an axis;

a base releasably fixed to the rod and adjustable relative to the rod along the axis;

a lock releasably fixing the base to the rod along the axis;

a pair of bearings each supported by the base, the cable extending between the pair of bearings, wherein the pair of bearings are spaced from each other and oppose each other; and another bearing supported by the base and extending along an axis, and wherein the pair of bearings each extend along a respective axis transverse to the axis of the another bearing.

8. The compound bow as set forth in claim 7 wherein the lock includes a flat on the rod and a set screw on the base aligned with the flat.

9. The compound bow as set forth in claim 7 wherein each of the pair of bearings includes a circumferential groove and wherein at least one of the circumferential grooves receive the cable.

10. The compound bow as set forth in claim 7 wherein the pair of bearings and the another bearing are each rotatable about their respective axes.

11. The compound bow as set forth in claim 7 wherein said axes of the pair of bearings are parallel to each other and the axis of the another bearing is perpendicular to the axes of the pair of bearings.

12. The compound bow as set forth in claim 7 wherein at least one of said pair of bearings and said another bearing is a needle bearing.

13. The compound bow as set forth in claim 7 wherein said base of said cable guard is stationary relative to said riser when the compound bow is moved from the brace position to a drawn position.

14. The compound bow as set forth in claim 7 further comprising a second cable and a second cable guard; the second cable guard including a second rod supported by the riser and extending along an axis, a second base releasably fixed to the second rod and adjustable relative to the second rod along the axis of the second rod, a second lock releasably fixing the second base to the second rod along the axis of the second rod, and a second pair of bearings each supported by the second base, the second cable extending between the second pair of bearings.

* * * * *